US011331668B2

(12) United States Patent
Bruus et al.

(10) Patent No.: US 11,331,668 B2
(45) Date of Patent: May 17, 2022

(54) METHODS AND DEVICES FOR ACOUSTOPHORETIC OPERATIONS IN POLYMER CHIPS

(71) Applicant: ACOUSORT AB, Lund (SE)

(72) Inventors: Henrik Bruus, Copenhagen (DK); Rayisa Moiseyenko, Taastrup (DK); Torsten Freltoft, Copenhagen (DK); Pelle Ohlsson, Lund (SE); Ola Jakobsson, Lomma (SE)

(73) Assignee: ACOUSORT AB, Lund (SE)

( * ) Notice: Subject to any disclaimer, the term of this patent is extended or adjusted under 35 U.S.C. 154(b) by 0 days.

(21) Appl. No.: 16/641,421

(22) PCT Filed: Aug. 31, 2018

(86) PCT No.: PCT/EP2018/073542

§ 371 (c)(1),
(2) Date: Feb. 24, 2020

(87) PCT Pub. No.: WO2019/043198

PCT Pub. Date: Mar. 7, 2019

(65) Prior Publication Data

US 2020/0238280 A1 Jul. 30, 2020

(30) Foreign Application Priority Data

Aug. 31, 2017 (EP) ..... 17188920

(51) Int. Cl.
*B01L 3/00* (2006.01)

(52) U.S. Cl.
CPC ..... *B01L 3/50273* (2013.01); *B01L 3/502707* (2013.01); *B01L 3/502753* (2013.01);
(Continued)

(58) Field of Classification Search
CPC ..... B01L 3/50273; B01L 3/502707; B01L 3/502753; B01L 3/502761;
(Continued)

(56) References Cited

U.S. PATENT DOCUMENTS

2014/0008307 A1* 1/2014 Guldiken ..... B01L 3/502761 210/748.05

FOREIGN PATENT DOCUMENTS

WO WO2007083295 7/2007
WO WO2012027366 3/2012

OTHER PUBLICATIONS

Bruus et al (Acoustofluidics 2: Perturbation theory and ultrasound resonance modes, Lab on a Chip, 2012, vol. 12, pp. 20-28 (Year: 2012).*

(Continued)

*Primary Examiner* — Benjamin R Whatley
*Assistant Examiner* — Jean Caraballo-Leon
(74) *Attorney, Agent, or Firm* — Klein, O'Neil & Singh, LLP

(57) ABSTRACT

The invention relates to a method of performing an acoustophoretic operation, comprising the steps of: a. providing an acoustophoretic chip comprising a polymer substrate in which a microfluidic flow channel is positioned, b. providing at least one ultrasound transducer in acoustic contact with one surface of the substrate, c. actuating the at least one ultrasound transducer at a frequency f that corresponds to an acoustic resonance peak of the substrate including the microfluidic flow channel filled with a liquid suspension, and d. providing the liquid suspension in the flow channel to perform the acoustophoretic operation on the liquid suspension. The invention further relates to an acoustophoretic
(Continued)

device, a method of producing an acoustophoretic device, and a microfluidic system comprising the acoustophoretic device.

20 Claims, 15 Drawing Sheets

(52) U.S. Cl.
CPC . *B01L 3/502761* (2013.01); *B01L 2200/0652* (2013.01); *B01L 2300/12* (2013.01); *B01L 2400/0439* (2013.01)

(58) Field of Classification Search
CPC ..... B01L 2200/0652; B01L 2300/12; B01L 2400/0439; B01L 2300/0816; B01L 2300/0864
See application file for complete search history.

(56) References Cited

OTHER PUBLICATIONS

González et al (A polymeric chip for micromanipulation and particle sorting by ultrasounds based on a multilayer configuration, Sensors and Actuators B: Chemical, 2010, vol. 144, pp. 310-317 (Year: 2010).*
International Search Report on corresponding PCT application (PCT/EP2018/073542) from International Searching Authority (EPO) dated Nov. 15, 2018.
Written Opinion on corresponding PCT application (PCT/EP2018/073542) from International Searching Authority (EPO) dated Nov. 15, 2018.
Gonzalez et al.; "Optimizing Polymer Lab-on-Chip Platforms for Ultrasonic Manipulation: Influence of the Substrate"; Micromachines; vol. 6, No. 7; pp. 574-591; XP055442093; May 7, 2015.
Harris et al.; "A Lateral Mode Flow-through PMMA Ultrasonic Separator"; 2 pages; 2010.
Lenshof et al.; "Acoustic Whole Blood Plasmapheresis Chip for Prostate Specific Antigen Microarray Diagnostics"; Analytical Chemistry; vol. 81, No. 15; pp. 6030-6037; Jul. 13, 2009.
Lenshof et al.; "Acoustofluidics 5: Building Microfluidic Acoustic Resonators"; Lab on a Chip; vol. 12, No. 4; pp. 684-695; XP055430406; Jan. 1, 2012.
Mueller et al.; "Continuous Acoustic Separation in a Thermoplastic Microchannel"; Journal of Micromechanics and Microengineering 23; pp. 1-10; Oct. 30, 2013.
Silva et al.; "Rapid Prototyping and Parametric Optimization of Plastic Acoustofluidic Devices for Blood-Bacteria Separation"; Biomedical Microdevices, Kluwer, Dordrecht, NL; vol. 19, No. 3; pp. 1-14; XP036303794; Aug. 4, 2017.

* cited by examiner $f = 0.993$ MHz, $E_{ac} = 68$ J/m$^3$, $p_{max} = 552$ kPa, $u_{max} = 40$ nm $F_{rad} = 107$ pN $f = 1.206$ MHz, $E_{ac} = 57$ J/m$^3$, $p_{max} = 598$ kPa, $u_{max} = 47$ nm $F_{rad} = 139$ pN $f = 1.257$ MHz, $E_{ac} = 22$ J/m$^3$, $p_{max} = 389$ kPa, $u_{max} = 25$ nm $F_{rad} = 54$ pN

METHODS AND DEVICES FOR ACOUSTOPHORETIC OPERATIONS IN POLYMER CHIPS

CROSS-REFERENCE TO RELATED APPLICATION

This application is the National Phase, under 35 U.S.C. § 371(c), of International Application No. PCT/EP2018/073542, filed Aug. 31, 2018, which claims priority from European Application No. EP 17188920.7, filed Aug. 31, 2017. The disclosures of all of the referenced applications are incorporated herein by reference in their entirety.

FEDERALLY SPONSORED RESEARCH OR DEVELOPMENT

Not Applicable

TECHNICAL FIELD OF THE INVENTION

The present invention relates generally to the field of acoustophoresis in which ultrasound is used to actuate waves in liquids and suspensions for interacting with different types of particles in said liquids and suspensions to perform inter alia separation and sorting of the particles. The present invention particularly relates to methods and devices for performing such acoustophoretic operations in polymer chips instead of the commonly used glass or silicon chips.

BACKGROUND OF THE INVENTION

Acoustophoresis has been used inter alia for separating different types of cells in suspensions such as separating blood cells from plasma or for separating and collecting circulating tumor cells from blood. Generally a microfluidic flow channel is fashioned in a substrate and the suspension is pumped through the flow channel under laminar flow conditions, or alternatively is stationary in the flow channel. An ultrasound transducer, particularly a piezoelectric element, is attached to the substrate and actuated to produce an ultrasonic vibration in the range of about 1-10 Mhz. Provided that the dimensions, in particular height or width, of the flow channel is properly matched with the frequency of the ultrasonic vibration, a standing wave may appear in the channel. This standing wave exerts a force on the particles in the suspension dependent on the acoustic contrast of each individual particle as determined by the properties of each particle relative to those of the suspending liquid in the suspension, and thus particles will be forced to move, dependent on the acoustic contrast, towards or away from the pressure node(s) of the standing wave.

Applications include, as stated above, separation, sorting, trapping and other manipulations of the particles.

Generally the substrate in which the microfluidic flow channel is fashioned is silicon or glass, or in some cases metal, as these materials have been found to have suitable properties. Attempts have been made to use chip substrates made of out of polymeric materials as such chips would be easier and less costly to manufacture (such chips being for example manufactured by injection moulding as opposed to the etching process commonly used with silicon and glass chips).

One such attempt is disclosed in N. R. Harris et al: "*A Lateral Mode Flow-through PMMA Ultrasonic Separator*" wherein an ultrasonic separator having a substrate made of Polymethyl (metacrylate), PMMA, is used to extract lipids from milk, the channel having a width corresponding to the wavelength of the ultrasound.

Another attempt is described in A Mueller et al: "*Continuous acoustic separation in a thermoplastic microchannel*" wherein a microfluidic channel made in a polystyrene substrate is used to perform acoustic separation on blood samples. The channel had a width corresponding to one half wavelength.

These attempts have however achieved only limited success as the acoustophoretic efficiency, including throughput and separation efficiency, has been low.

Also surface acoustic waves (SAW) can be used to induce acoustophoresis in a channels defined at least in part by polymer walls, but these systems are also very limited in separation efficiency and/or troughput. One example is described by Jeonghun Nan et al in "Separation of platelets from whole blood using standing surface acoustic waves in a microchannel", where 0.25 μL blood was processed per minute, compared to flow rates more than 300 times higher in silicon and glass systems such as the one described by Lenshof et al in "Acoustic Whole Blood Plasmapheresis Chip for Prostate Specific Antigen Microarray Diagnostics".

OBJECTS OF THE INVENTION

The present invention aims at obviating the aforementioned disadvantages and failings of previously known polymer chips and methods of their use, in particular the low acoustophoretic efficiency A primary object of the present invention is therefore to provide a method of performing an acoustophoretic operation in an acoustophoretic chip or device having a polymer substrate.

A further object of the present invention is to provide such a method having practically useful throughput and separation efficiency It is yet another object of the present invention to provide a method of producing an acoustophoretic device having a polymer substrate and an acoustophoretic device having such a polymer substrate.

SUMMARY OF THE INVENTION

At least one of the abovementioned objects or at least one of the further objects which will become evident from the below description, are according to a first aspect of the present invention achieved by a method of performing an acoustophoretic operation, the method comprising the steps of:

a. providing an acoustophoretic chip comprising a polymer substrate in which a microfluidic flow channel is positioned,
b. providing at least one ultrasound transducer in acoustic contact with the substrate,
c. actuating the at least one ultrasound transducer at a frequency f that corresponds to an acoustic resonance peak of at least the substrate, preferably including the microfluidic flow channel filled with a liquid suspension, and
d. providing the liquid suspension in the flow channel to perform the acoustophoretic operation on the liquid suspension.

At least one of the abovementioned objects or at least one of the further objects which will become evident from the below description, is further, according to a second aspect of the present invention, achieved by a device for performing an acoustophoretic operation, comprising:

an acoustophoretic chip comprising a polymer substrate and a microfluidic flow channel positioned within the substrate, at least one ultrasound transducer in acoustic contact with the substrate, and a drive circuit connected to the at least one ultrasound transducer and being configured to actuate the at least one ultrasound transducer at a frequency f that corresponds to an acoustic resonance peak of at least the substrate, preferably including the microfluidic flow channel filled with a liquid suspension.

Thus the present invention is based on the discovery by the present inventors that, for efficient acoustophoretic operations to be possible in chips having a small difference in acoustic impedance compared to the medium in the channel, such as chips made from polymer substrates, at least one acoustic resonance peak of at least the entire substrate and preferably also including the microfluidic flow channel must be found and the substrate actuated at this frequency. Accordingly it is not enough to actuate the substrate with a frequency that is adapted to the dimensions of the microfluidic channel (where the width and/or height of the channels should correspond to one or more half wavelengths and the corresponding frequencies, as is commonly done in glass or silicon substrates), instead for low acoustic impedance substrates such as polymeric substrates it is the resonance conditions in the entire substrate that are the significant determinator as to whether resonance, and hence a useful acoustic force for performing the acoustophoretic operation, arises.

Accordingly it is the interface formed by the differing acoustic impedance of the substrate and the surrounding air at the outer surface of the substrate that causes reflection of the sound so that resonance is obtained.

In other words previous attempts to use polymeric substrates have been based on design and actuation principles from silicon and glass substrates, including actuating the substrates using ultrasound at a frequency adapted to the dimensions of the flow channel. However, as the present inventors have found and established, the dimensions of the channel are actually of less importance, instead for polymeric substrates the resonance in the whole substrate must be taken into account. This resonance could be a one- or two-dimensional standing wave, but is preferably a three-dimensional volume resonance of the whole substrate including the microchannel that may or may not be possible to describe as a one- or two-dimensional resonance or superposition of such resonances.

Thus the simulations in example 1 evidence the unexpectedly strong importance of global three-dimensional resonances. Whereas conventional glass/silicon chips employ a longitudinal pressure resonance in the channel, polymeric chips will employ longitudinal or shear wave resonance in the whole substrate.

The present invention is further based on the discovery by the present inventors that the manner of actuation of a polymeric substrate is also of strong importance to the acoustophoretic effect obtained in the flow channel. Actuation of a silicon or glass substrate using a single ultrasound transducer will, dependent on which resonance frequency is used, in the typical case lead to a standing wave and a force which concentrates particles, the particles having a positive acoustic contrast (i.e. depending on their density and compressibility) in relation to the fluid the particles were suspended in, towards the center of the flow channel. The same actuation of a dimensionally identical polymeric substrate would instead typically not lead to any effect at all. Here example 1 evidences that, in order to obtain a similar focusing of the particles towards the center of the flow channel at least two ultrasound transducers actuated asymmetrically, e.g. in counter phase where there is a 180° phase shift between the ultrasound emitted from each one ultrasound transducer relative to the other ultrasound transducer, are needed Accordingly, it is now for the first time possible to efficiently use polymeric substrates for acoustophoretic operations.

As stated above this provides for using polymeric substrates which are easier and less costly to manufacture than the previous silicon and glass substrates, as well as easier to integrate with other operations performed in polymeric cartridges.

The acoustophoretic operation generally involves affecting a liquid or suspension including any particles in the suspension and may include one or more of focusing, i.e. causing particles to move to discrete areas of the microfluidic flow channel, trapping, i.e. retaining particles in the microfluidic flow channel, separating, i.e. causing different particles (which particle differ in size and/or acoustic contrast compared to the liquid in the microfluidic flow channel) to move in different directions and/or with different speeds.

In the context of the present invention acoustophoretic chip is to be understood as encompassing acoustophoretic device, acoustophoresis chip, acoustophoresis device.

The polymer substrate may be made from a number of different polymer materials, in particular plastics such as cyclic olefin copolymer (COP), cyclic olefin polymers (COC), polycarbonate (PC), polypropylene (PP) poly(methyl methacrylate) (PMMA), polystyrene (PS), of which COC, COP, PS and PP are most preferred in the embodiments of the present invention. The material should have a low enough acoustic damping coefficient to allow acoustic resonance in the substrate.

The substrate may have different shapes, lengths, heights and widths provided that there exists a resonance peak corresponding to resonance in the substrate at a frequency in the ultrasound range, preferable in the range of 0.2 to 20 MHz, more preferably in the range of 0.8 to 8 MHz, most preferably in the range of 1 to 5 MHz.

Typically the substrate has a bottom surface, an opposing top surface, two opposing side surfaces, and two opposing end surfaces. The length, height and width of the substrate are typically in the range of 10-100 mm (length) 0.5 to 3 mm (height), and 1-10 mm (width).

The microfluidic flow channel may run along at least a part of the substrate and may be provided with inlets and outlets at its opposite ends. The microfluidic flow channel may have a floor, a ceiling, and two opposing side walls. Typically the microfluidic flow channel will have a rectangular or substantially rectangular cross section. The width of the microfluidic flow channel is typically from 0.1 to 1 mm and the height 0.05 to 0.3 mm, depending on the size of any particle that is to pass through the microfluidic flow channel. It is to be understood that a liquid or suspension in the microfluidic flow channel need not be in flow.

In some embodiments the width the microfluidic flow channel can be up to 2 mm and the height of microfluidic flow channel can be up to 1 mm.

The microfluidic flow channel is positioned in the polymer substrate such that the resonance in the substrate gives rise to acoustic forces on any particle having a different acoustic contrast than the liquid the particle is suspended in. Typically the substrate is fashioned from two parts so that the channel may be easily implemented as a trough or groove in one of the parts whereafter the other part is placed as a lid to seal the trough or groove to form the channel. The channel may further have different dimension at different positions along its length.

The ultrasound transducer is preferably a piezoelectric crystal to which electrodes have been attached in order to supply electric energy to the crystal. The ultrasound transducer may be placed at different positions on the substrate. Where the substrate comprises a base substrate in which the channel is formed as a groove or similar, and wherein a lid substrate is attached to the base substrate to cover and together with the base substrate define the channel, the ultrasound transducer may preferably be attached to the lid substrate so that it is close to the microfluidic flow channel.

In preferred embodiments of the methods, device and system according to the present invention the inherent resonance frequency of the ultrasound transducer is preferably the same as the frequency f so as to maximize the efficiency.

The at least one ultrasound transducer may be in acoustic contact with the substrate by being in direct physical contact, or by being in indirect physical contact via for example an acoustically conducting material. Actuating the at least on ultrasound transducer may encompass providing a signal, such as a sine or square wave signal to the ultrasound transducer in order to force the ultrasound transducer to vibrate at or near the frequency of the actuation. Actuating the at least one ultrasound transducer at the frequency f is further to be understood as encompassing supplying ultrasound energy at the frequency f to the substrate.

The frequency f is typically in the range of 0.2 to 20 MHz. Typically the frequency that results in resonance in the substrate is different from the frequency that would result in resonance in the microfluidic flow channel. In some embodiments of the methods, acoustophoretic device and microfluidic system according to the aspects of the present invention the frequency f therefore does not correspond to any resonance peak of the microfluidic flow channel. Expressed otherwise the frequency f does not correspond to a resonance frequency of the channel alone in these embodiments.

In some embodiments of the methods, acoustophoretic device and microfluidic system according to the aspects of the present invention the acoustic resonance peak corresponds to three-dimensional volume resonance in the substrate, preferably including the microchannel. Preferably the three-dimensional volume resonance cannot be described as a one- or two-dimensional resonance in the substrate.

In the context of the present invention corresponds is to be understood as preferably, but not exclusively, relating to an exact match of the frequencies—it is contemplated that a satisfactory actuation of the substrate will be possible even where the frequency f differs from the resonance peak by no more than 30%, preferably no more than 20% and most preferably no more than 10%.

The acoustic resonance peak is the frequency where the acoustic energy in the substrate reaches a maximum. There may be several acoustic resonance peaks for a given substrate.

The resonance peak should at least correspond to a resonance peak of the substrate in its entirety. Preferably the resonance peak should correspond to the resonance of the substrate including the microfluidic flow channel including the liquid inside the flow channel. It is further contemplated that the resonance peak could further correspond to the resonance of the substrate, liquid in the microfluidic channel, and the at least on ultrasound transducer.

This resonance could be a one- or two-dimensional standing wave, but is preferably a three-dimensional volume resonance of the whole substrate including the microchannel that may or may not be possible to describe as a one- or two-dimensional resonance or superposition of such resonances.

The liquid suspension may be provided in the microfluidic channel by pumping, suction, etc. The liquid suspension may be flowed through the microfluidic flow channel or injected and stopped in the channel.

The liquid suspension may be a disperse fluid such as undiluted or diluted whole blood, intracellular fluid, interstitial fluid, synovial fluid, peritoneal fluid, urine, yeast cell cultures, bone marrow, stroma, dissociated cells from normal or cancerous tissue, milk. The liquid suspension may comprise particles such as red blood cells, white blood cells, platelets, cancer cells, bacterial cells, viruses, yeast cells, dust particles, silica particles and polymer particles.

The drive circuit may comprise a function generator electrically connected to the ultrasound transducer In preferred embodiments of the methods, device and system according to the aspects of the present invention the acoustic resonance peak corresponds to three-dimensional resonance in the substrate, such as three-dimensional volume resonance in the whole substrate including the microfluidic flow channel.

In preferred embodiments of the method according to the first aspect of the present invention at least two ultrasound transducers are provided in step b in acoustic contact with the substrate, and the at least two ultrasound transducers are actuated in step c out of phase, preferably in antiphase, with respect to each other.

In preferred embodiments of the device according to the second aspect of the present invention the acoustophoretic device comprises at least two ultrasound transducers in acoustic contact with the substrate, and the drive circuit is further configured to actuate the at least two ultrasound transducers, out of phase relative to each other, at the acoustic resonance frequency f.

The two ultrasound transducers may be separate, however in preferred embodiments of the method and device they share a single common piezoelectric crystal. Such ultrasound transducer may be manufactured by providing both sides of a piezoelectric crystal with an electrode material and cutting one of the sides so as to define two separate electrodes. Preferably the cutting also involves cutting into the piezoelectric crystal, such as a distance of 0.05 to 0.4 mm, so as to allow the different parts, i.e. the two electrodes/ultrasound transducers, to be actuated with less effect on each other.

Out of phase is to be understood as any phase shift between the two signals to the two ultrasound transducer. Preferably however the phase shift is 160° to 200°, such as preferably 170° to 190°, such as preferably 175° to 185°, most preferably 180° (antiphase).

The two ultrasound transducers are preferably in acoustic contact with one surface of the substrate. The two ultrasound transducers are preferably positioned side by side in acoustic contact with one surface of the substrate. In other words the two ultrasound transducers may be considered to be non-opposing.

The one surface of the substrate may be any surface of the substrate, but is typically the bottom surface or the top surface, and preferably the bottom surface.

In preferred embodiments of the methods, device and system according to the aspects of the present invention the acoustophoretic operation comprises focusing particles, suspended in a suspension within the microfluidic flow channel, towards one or more discrete areas of the microfluidic flow channel.

Focusing is to be understood as encompassing moving.

In preferred embodiments of the methods, device and system according to the aspects of the present invention the substrate additionally comprises a further microfluidic flow channel, the further microfluidic flow channel being positioned so that that an acoustic force arises, due to resonance in the substrate preferably including the microfluidic flow channel and the further microfluidic flow channel, on a target particle in the further microfluidic channel, the acoustic force being the same, or different, from an acoustic force arising on a target particle in the microfluidic channel.

This embodiment utilizes the fact that the present invention takes into account the resonance in the entire substrate. In particular the acoustic force may be dependent on the position of a channel within the substrate, thus providing for obtaining different acoustic forces in different parts of the substrate.

The target particle is the particle or particles which should be moved or otherwise affected by the acoustophoretic operation.

The further microfluidic flow channel may have the same dimensions and configuration as described above for the microfluidic flow channel.

The present invention involves a new principle of designing and manufacturing acoustophoretic devices using polymeric substrates. At least one of the abovementioned objects, or at least one of the further objects which will become evident from the below description, is therefore, according to a third aspect of the present invention, achieved by a method of producing an acoustophoretic chip for performing an acoustophoretic operation, the acoustophoretic chip comprising a polymer substrate in which a microfluidic flow channel is provided, comprising the steps of:

a. determining, by calculation or simulation, the acoustic resonances of the substrate for each of a plurality of different combinations of parameter values of substrate parameters, the substrate parameters including polymeric substrate material, substrate dimensions, microfluidic flow channel dimensions, microfluidic flow channel positions within the substrate, properties of a liquid in the microfluidic flow channel, positions for at least one ultrasound transducer, and actuation frequency f, and
b. selecting, among the plurality of different combinations of the parameter values of the substrate parameters, a polymeric substrate material (or a combination of materials) M, a set of substrate dimensions $D_S$, a set of microfluidic flow channel dimensions $D_C$, a microfluidic flow channel position $P_C$ within the substrate, properties of the liquid L in the microfluidic flow channel, a position $P_U$ for at least one ultrasound transducer, and an actuation frequency f, which yield acoustic resonance within the substrate including the microfluidic flow channel, and
c. manufacturing the acoustophoretic chip made out of the substrate material (or combination of materials) M having the substrate dimensions $D_S$ and being provided with a microfluidic flow channel having the microfluidic flow channel dimensions $D_C$ and the microfluidic flow channel position $P_C$ within the substrate.

As discussed above for the method according to the first aspect of the present invention the general design principles used for silicon or glass substrates do not hold true for polymeric substrates. Accordingly the method according to the second aspect of the present invention takes into account in particular the dimensions of the polymeric substrate and the position of the microfluidic flow channel within the substrate.

In the context of the present invention producing is to be understood as encompassing designing and/or constructing. The method according to the third aspect of the present invention may alternatively comprise steps a and b, whereby the selected parameters, i.e. the polymeric substrate material (or a combination of materials) M, the set of substrate dimensions $D_S$, the set of microfluidic flow channel dimensions $D_C$, the microfluidic flow channel position $P_C$ within the substrate, the properties of the liquid L in the microfluidic flow channel, the position $P_U$ for at least one ultrasound transducer, and the actuation frequency f, define design parameters for designing the acoustophoretic chip.

The calculation or simulation preferably comprises simulating the acoustic resonances in at least a two-dimensional, preferably a three-dimensional, model of the substrate. The parameter values may all be varied over a range of possible values, typically however some of the values are set, such as for example substrate material and substrate dimensions. Typically therefore it is the frequency that is varied in order to find a frequency giving rise to resonance.

The method according to the third aspect of the present invention may also be performed for substrate parameters which include several channels each having its own set of microfluidic flow channel dimensions, microfluidic flow channel positions within the substrate, and properties of a liquid in the microfluidic flow channel.

Thus the method may be used to manufacture or design acoustophoretic chips having more than one channel for performing more than one acoustophoretic operation.

In step a a plurality of more than one actuation frequency may be included in determining the acoustic resonances of the substrate. Thus, in step b, more than one actuation frequency f may be selected in order to generate a superposition of the acoustic fields generated by each frequency.

This may for example be useful where determining the acoustic resonances of the substrate reveals that there are several useful resonance frequencies or when a superposition of them is desired.

Where in step a a plurality of positions for two ultrasound transducers is included in determining the acoustic resonances of the substrate, then a plurality of phase difference between the two ultrasound transducers may be included in determining the acoustic resonances of the substrate, and a phase difference between the two ultrasound transducers may be selected in step b.

In preferred embodiments of the method according to the third aspect of the present invention the method further comprises the step of attaching at least one ultrasound transducer to the substrate at the position $P_U$ for the at least one ultrasound transducer.

In preferred embodiments of the method according to the third aspect of the present invention simulation is used in step a, the simulation using as boundaries the polymer/air interface at the outer surfaces of the substrate and the polymer/liquid interface at walls of the microfluidic flow channel.

In preferred embodiments of the method according to the third aspect of the present invention step a further comprises determining the acoustic force on a target particle throughout the substrate for each of the plurality of different combinations of parameter values of substrate parameters, and step b further comprises determining the set of microfluidic flow channel dimensions $D_C$ and the microfluidic flow channel position $P_C$ within the substrate so that the microfluidic flow channel at least partly delimits a region of the substrate in which the acoustic force on the target particle is suitable for performing the acoustophoretic operation.

Alternatively the acoustic force on the target particle is determined throughout the microfluidic flow channel for each of the plurality of different combinations of parameter values of substrate parameters.

Step a and b may be performed without considering the channel or channels in order to find substrate resonances in cases where the channel volume is small enough in relation to the substrate volume to have a small effect on the substrate resonances. The channel or channels are however preferably included if the acoustic field calculation if the acoustic field and resulting particle forces are to be calculated in the channel, unless the acoustic properties are similar enough for the substrate and channel to approximate the channel content with the substrate material.

In preferred embodiments of the method according to the third aspect of the present invention step the acoustophoretic chip is suitable for performing a further acoustophoretic operation, and wherein the substrate parameters additionally comprises further microfluidic flow channel dimensions and further microfluidic flow channel positions within the substrate, for a further microfluidic flow channel.

In preferred embodiments of the method according to the third aspect of the present invention the acoustophoretic operation and the further acoustophoretic operation are different, and step b further comprises determining a further set of microfluidic flow channel dimensions $D_{C2}$ and microfluidic flow channel positions $P_{C2}$ within the substrate so that the further microfluidic flow channel at least partly delimits a further region of the substrate in which the acoustic force on a target particle is suitable for performing the further acoustophoretic operation.

Having an acoustophoretic device having a polymeric substrate further allows for including acoustophoretic devices and operations in microfluid systems.

At least one of the abovementioned objects, or at least one of the further objects which will become evident from the below description, is therefore, according to a fourth aspect of the present invention, achieved by a microfluidic system comprising

- a polymeric main substrate having a substrate surface in which is formed a first set of projections, such as walls, or depressions, such as grooves,
- a polymeric lid substrate placed over the substrate surface so as to define, together with the first set of projections or depressions, at least one microfluidic channel,
  wherein a part of the microfluidic flow channel extends through an acoustophoretic region of the main substrate, in which region an acoustophoretic operation is to be performed,
  wherein a second set of projections or depressions are provided in the polymeric main substrate in or adjacent the acoustophoretic region so as to at least partially separate the acoustophoretic region from the remainder of the polymeric main substrate, and
- at least two ultrasound transducers in acoustic contact with the polymeric lid substrate on the side of the polymeric lid substrate facing away from the substrate surface, the at least two ultrasound transducers being positioned on the polymeric lid substrate so as to cover at least part of the acoustophoretic region, and
- a drive circuit connected to the at least two ultrasound transducers and being configured to actuate, preferably out of phase or in antiphase, the at least two ultrasound transducers at a frequency f corresponding to a resonance peak of the acoustophoretic region of the polymeric main substrate, preferably including the microfluidic flow channel and/or a part of the polymeric lid substrate facing the acoustophoretic region.

The polymeric main substrate is preferably made of any one or more of the materials of the polymeric substrates described above. The polymeric main substrate is typically planar with a rectangular form.

The polymeric lid is preferably made of any one or more of the materials of the polymeric substrates described above, that may or may not be the same as the substrate material. The polymeric lid is preferably shaped to correspond to the shape of the polymeric main substrate; however, it is preferably thinner.

The second set of projections or depressions may, in the case of depressions, be so deep as to pierce the polymeric main substrate so as to the highest extent possible separate the acoustophoretic region from the remainder of the main substrate. The acoustophoretic region may encompass an acoustophoretic chip or device according to the second aspect of the present invention Further advantages with and features of the invention will be apparent from the other dependent claims as well as from the following detailed description of preferred embodiments.

BRIEF DESCRIPTION OF THE DRAWINGS AND DETAILED DESCRIPTION

A more complete understanding of the abovementioned and other features and advantages of the present invention will be apparent from the following detailed description of preferred embodiments in conjunction with the appended drawings, wherein:

FIG. 1 shows the set up and results of 2D simulations of resonances in a PMMA chip substrate, FIG. 1A showing the setup, FIGS. 1B-D showing the resonance frequencies for chips having different widths, FIGS. 1E-1L showing the radiation force in the substrate and the channel at selected resonance frequencies, FIGS. 1M-1N showing the radiation force for symmetric actuation, FIG. 2 shows results of 3D simulations of resonances in a part of a PMMA chip substrate, FIG. 2A showing the resonance frequencies and FIGS. 2B-2C showing the radiation force on a 10 μm polystyrene bead in a water filled channel at the two main resonance frequencies, FIG. 3 shows results of further 3D simulations of resonances in two differently dimensioned PMMA chip substrate, FIGS. 3A and 3C showing the resonance frequencies and FIGS. 3B and 3D showing the radiation force on a 10 μm polystyrene bead in a water in a part of the flow channel, FIG. 4 shows microscope images of the flow channel during experimental validation of the resonance frequencies predicted by the simulations, FIGS. 4A-4C showing the results for the chip 1A (the channel (A), beads flowing through the channel at 50 μL/min without ultrasound (B) and beads at the same flow rate focused at a frequency of 1.3 MHz (C)), and FIGS. 4D-4G showing the results for chip 1B (the channel (D), beads flowing through the channel at 50 μL/min without ultrasound (E) and beads focused at a frequency of 1.55 MHz flowing at 100 μL/min (F) and beads focused at the same frequency flowing at 200 μL/min(G)), FIG. 5 schematically shows the construction of acoustophoretic chips having polymeric substrates, FIG. 1A showing the general construction including the split piezo-ceramic element, FIG. 5B showing an acoustophoretic device according to the third aspect of the present invention, and FIGS. 5C and 5D showing a top view and a cross sectional view, respectively, of a microfluidic system according to the fourth aspect of the present invention, and FIG. 6 showing flow sheets of embodiments of methods according to the first and third aspects of the present invention.

EXAMPLE 1A

Initial 2D Simulations of PMMA Chip

Materials and Methods

For the 2D simulation experiments a PMMA ship was modeled using the geometry shown in FIG. 1A The parameter values were as follows:

| | |
|---|---|
| PMMA Chip dimension | WB = 3.0 mm, HB = 1.0 ram, HL = 0.175 mm (variations: WB = 1.5 mm, 3.0 mm, 5.0 mm) |
| PMMA Density ($\rho$) | 1170 kg $m^{-3}$ |
| PMMA longitudinal speed of sound ($c_L$) | 2706 m $s^{-1}$ |
| PMMA transverse speed of sound ($c_T$) | 1105 m $s^{-1}$ |
| PMMA damping ($\alpha$) | 10 $m^{-1}$ |
| PMMA damping coefficient ($\Gamma$) | 0.0043 |
| Water (channel) dimensions | w = 0.375 mm, h = 0.150 mm |
| Water density ($\rho_0$) | 997 kg $m^{-3}$ |
| Water Speed of sound ($c_0$) | 1497 m $s^{-1}$ |
| Water damping coefficient ($\Gamma$) | 0.004 |
| Test particle | spherical 10-μm-diameter polystyrene bead |
| Test particle acoustophoretic mobility ($\mu_{ac}$) | 12 (μm $s^{-1}$)/pN |
| Test particle buoyancy-corrected gravity ($F_{gr}$) | 0.26 pN |
| Test particle time for sedimention h = 150 μm ($t_{sed}$) | 48 s |
| Asymmetric Actuation at frequency f and amplitude 1 nm | |

Simulations were run for a range of frequencies f from 0 to 2 MHz and the acoustic energy ($E_{ac}$) was determined as shown in FIG. 1B (for $W_B$=1.5 mm), FIG. 1C (for $W_B$=3.0 mm), and FIG. 1D (for $W_B$=5.0 mm)

The simulations were based on the Finite element method (FEM) using the numerical FEM software COMSOL. FEM is a method where a discretized into a plurality of triangular mesh cells of finite sizes, i.e. into a plurality of finite element wherein a local approximation of the problem can be solved for each finite element and a global solution can be pieced together.

The simulations made use of an Eigenmode analysis of Eigenfrequency for various widths of the simulated chip/substrate and introduced additional resonance modes beyond resonance in merely one dimension of the substrate. A frequency-response analysis established resonance frequencies of the substrate, and, taking into account and modeling the dissipative losses in the fluid (water filled channel) and the bulk material (the PMMA) the magnitude and direction of the displacement field in the substrate and the pressure field in the channel, could be determined. From this the acoustic radiation force on a potential particle in the channel could be determined using the formula:

$$F^{rad} = -\pi a^3\left[\frac{2\kappa_{wa}}{3}\mathrm{Re}[f_1^* p^* \nabla p] - \rho_{wa}\mathrm{Re}[f_2^* v^* \cdot \nabla v]\right] \quad v = -i\frac{1}{\rho_0\omega}\nabla p$$

Results

As seen in FIGS. 1B-1D all three chip widths ($W_B$) resulted in a number of actuation frequencies where the acoustic energy ($E_{ac}$) peaked signifying a resonance in the whole chip.

In FIG. 1B ($W_B$=1.5 mm) the following resonance frequencies were found:

| Frequency f (MHz) | Acoustic energy $E_{ac}$ (J/$m^3$ | Force acting on test particle $F_{rad}$ (pN) | Maximum pressure in channel pmax (kPa) |
|---|---|---|---|
| 0.18 | 0.5 | 0.2 | 10 |
| 0.993 | 68 | 107 | 552 |
| 1.206 | 57 | 139 | 598 |
| 1.644 | 10 | 36 | 253 |
| 1.815 | 2 | 10 | 153 |

As is seen from the above table there are two frequencies, 0.993 MHz and 1.206 MHz, which give rise to strong forces on the test particle. These frequencies are far removed from the frequencies obtained in the prior art principle of actuating acoustophoretic chips as typically a frequency of 2 MHz would be used to actuate a channel having the width of 0.375 mm (the channel width corresponding to one half wavelength. However, in FIG. 1B there is no peak in acoustic energy at f=2.0 MHz, rather there is instead a walley here. A similar result is seen in FIG. 1D. For FIG. 1B there is no peak at 2.0 MHz—the peak at 2.025 MHz is lower than the peak at 1.860 MHz.

Thus the conventional way of selecting actuation frequency based on the dimensions of the microfluidic flow channel results in non-optimal actuation of the PMMA chip.

FIGS. 1E-F show the magnitude and direction of the displacement field in the substrate and the pressure field in the channel, and the magnitude and direction of the radiation force on a 10 μm diameter polystyrene bead in water in the channel, respectively, for f=0.993 MHz.

FIGS. 1G-H the magnitude and direction of the displacement field in the substrate and the pressure field in the channel, and the magnitude and direction of the radiation force on a 10 μm diameter polystyrene bead in water in the channel, respectively, for f=1.206 MHz.

As is shown in these figures the simulation results for both 0.993 MHz and 1.206 MHz give a strong, near-1D, focusing of the particles into a single band in the center of the channel In FIG. 1C ($W_B$=3.0 mm) the following resonance frequencies were found:

| Frequency f (MHz) | Acoustic energy $E_{ac}$ (J/$m^3$ | Force acting on test particle $F_{rad}$ (pN) | Maximum pressure in channel pmax (kPa) |
|---|---|---|---|
| 0.21 | 0.2 | 0.03 | 7 |
| 0.445 | 0.5 | 0.39 | 25 |
| 1.257 | 22 | 54 | 389 |
| 1.590 | 2 | 36 | 131 |
| 1.860 | 42 | 21 | 520 |

As is shown in these figures also the wider chip ($W_B$=3.0 mm) has a moderately strong focusing into one band in the center of the channel at 1.257 MHz. At 1.860 MHz the particles are focused into a central band and two lateral spots.

Figure 1A:
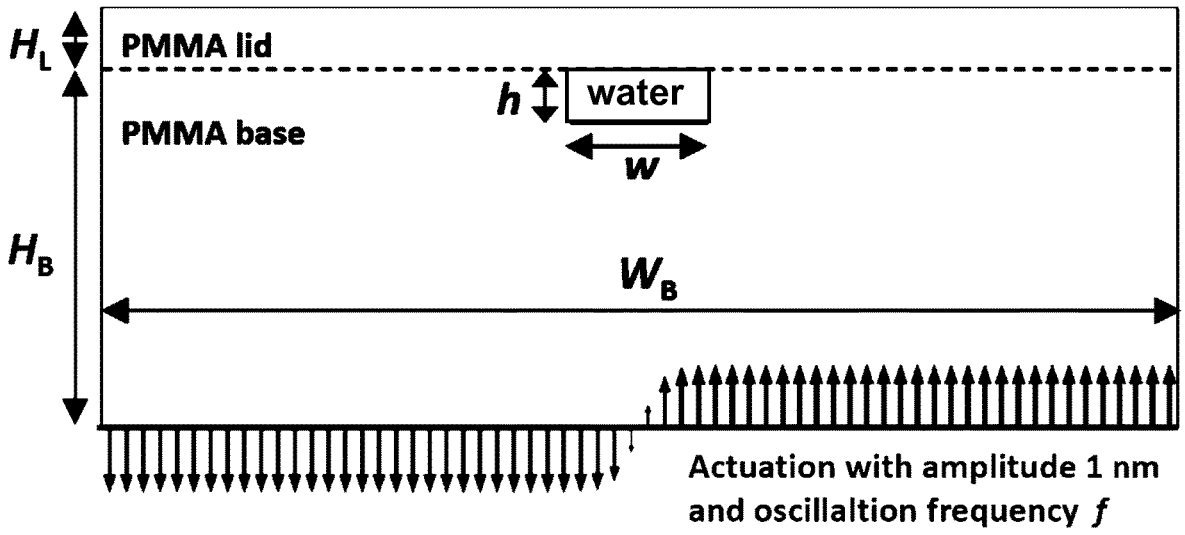
FIG. 1I shows the magnitude and direction of the displacement field in the substrate and the pressure field in the channel (left/background) and the magnitude and direction of the radiation force on a 10 μm diameter polystyrene bead in water in the channel (right/foreground), respectively, for f=1.257 MHz.
FIG. 1J shows the magnitude and direction of the displacement field in the substrate and the pressure field in the channel (left/background) and the magnitude and direction of the radiation force on a 10 μm diameter polystyrene bead in water in the channel (right/foreground), respectively, for f=1.590 MHz.
Figure 1B:
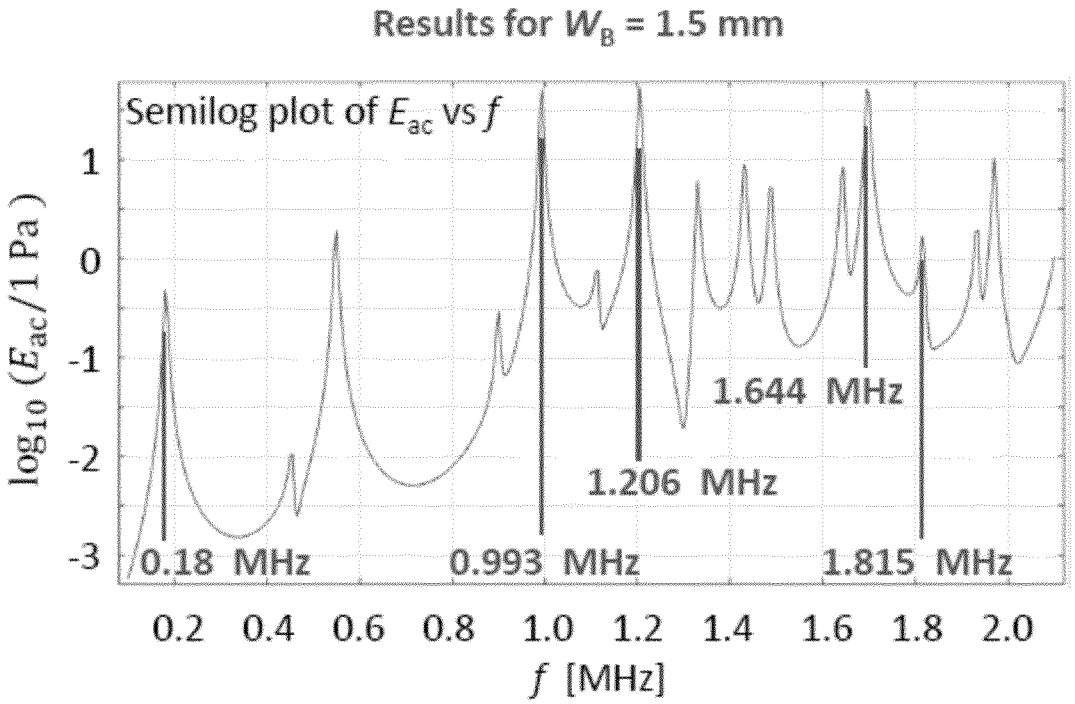
Figure 1C:
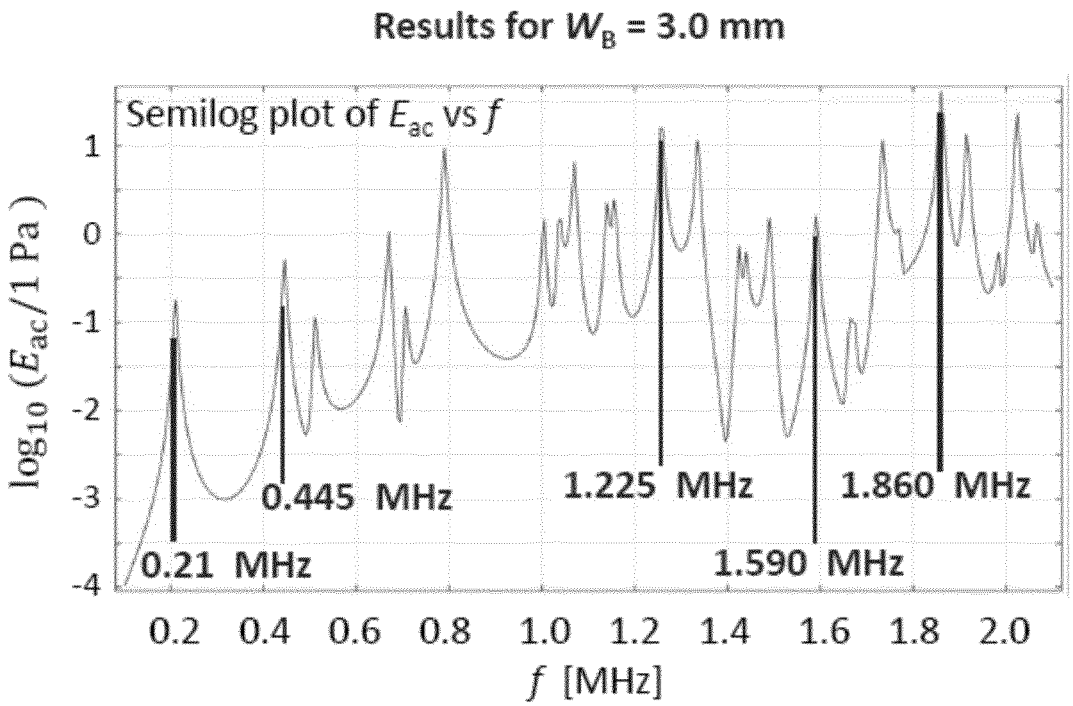
Figure 1D:
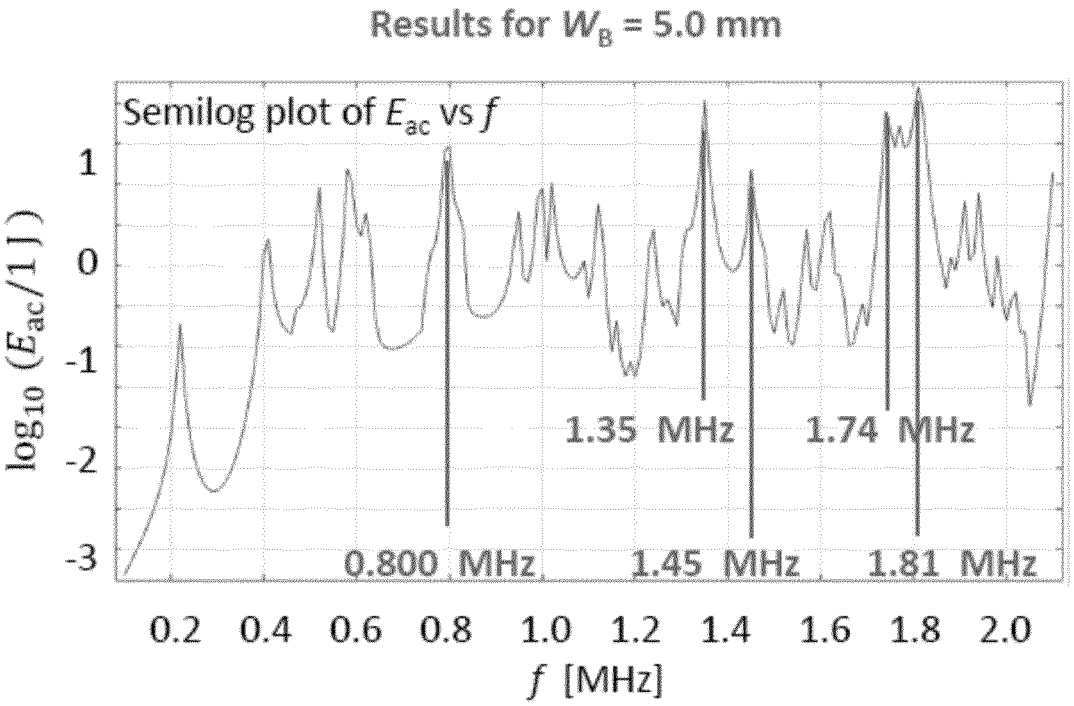

In FIG. 1D ($W_B$=5.0 mm) the following resonance frequencies were found:

| Frequency f (MHz) | Acoustic energy $E_{ac}$ (J/m$^3$ | Force acting on test particle $F_{rad}$ (pN) | Maximum pressure in channel pmax (kPa) |
|---|---|---|---|
| 0.800 | 9 | 16 | 215 |
| 1.35 | 34 | 84 | 517 |
| 1.45 | 5 | 12 | 208 |
| 1.74 | 25 | 104 | 498 |
| 1.81 | 50 | 136 | 706 |

Figure 1E:
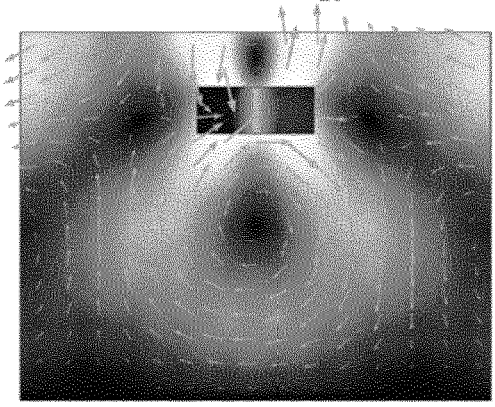
Figure 1F:
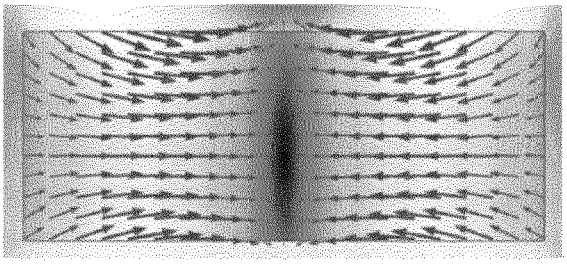
Figure 1G:
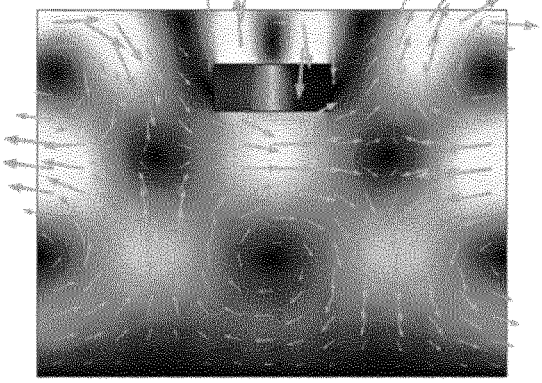
Figure 1H:
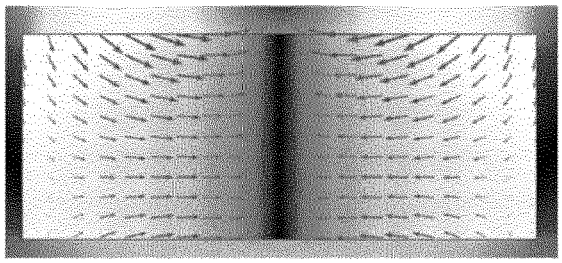
Figure 1I:
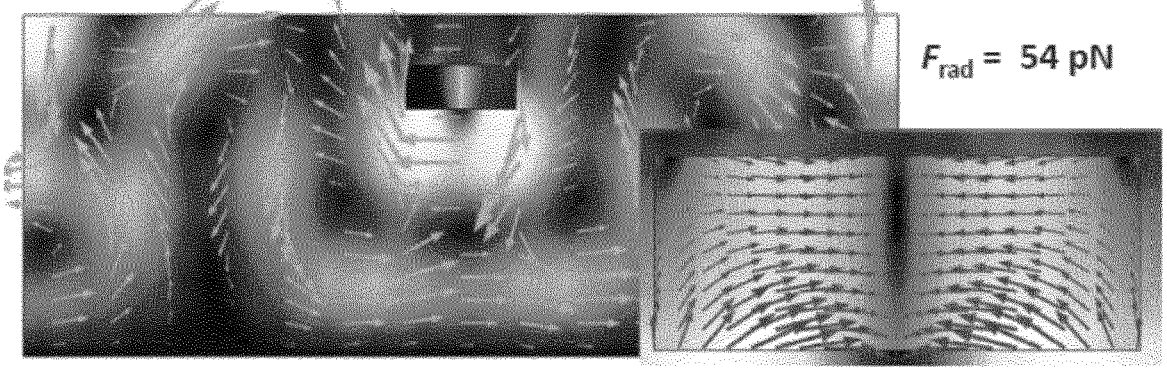
Figure 1J:
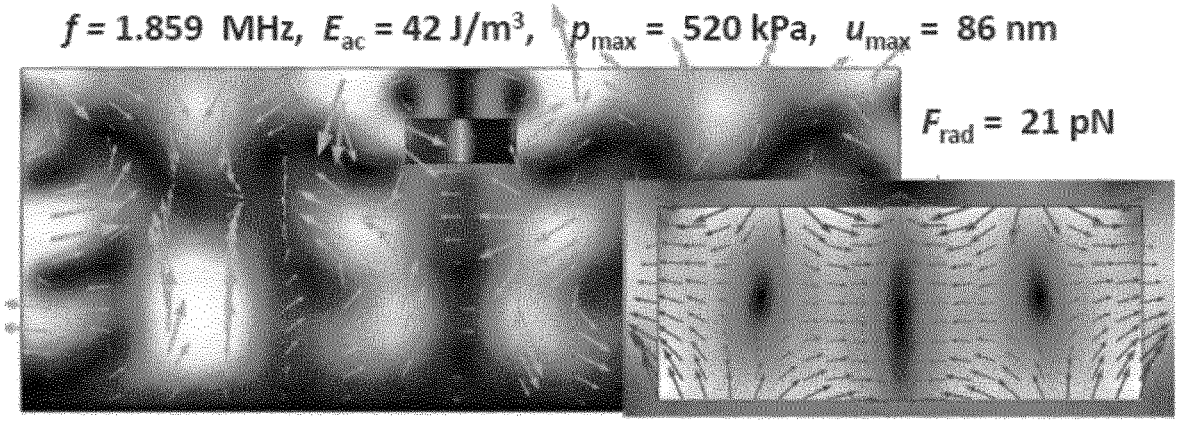
Figure 1K:
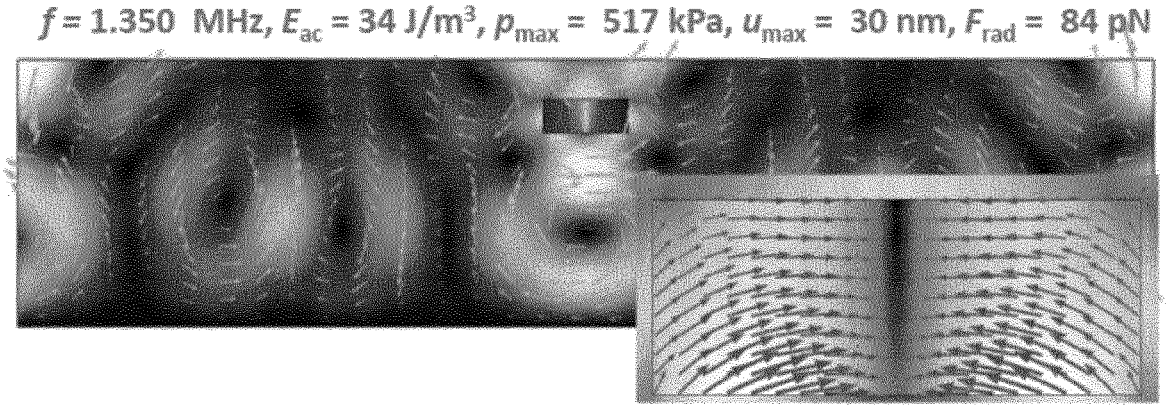

FIG. 1K shows the magnitude and direction of the displacement field in the substrate and the pressure field in the channel (left/background) and the magnitude and direction of the radiation force on a 10 μm diameter polystyrene bead in water in the channel (right/foreground), respectively, for f=1.35 MHz.

Figure 1L:
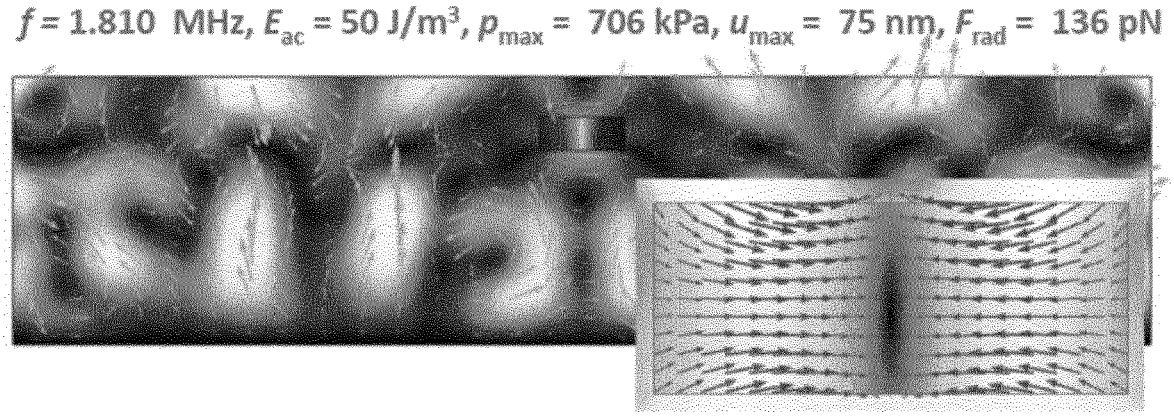

FIG. 1L shows the magnitude and direction of the displacement field in the substrate and the pressure field in the channel (left/background) and the magnitude and direction of the radiation force on a 10 μm diameter polystyrene bead in water in the channel (right/foreground), respectively, for f=1.810 MHz.

As is shown in these figures also the widest chip ($W_B$=5.0 mm) has a strong focusing of the particles into one band in the center of the channel.

In a further simulation the geometry of the PMMA chip shown in FIG. 1A with $W_B$=3 mm was inverted with the transducers attached to the lid. This variant also resulted in a number of strong resonances:

| Frequency f (MHz) | Force acting on test particle $F_{rad}$ (pN) |
|---|---|
| 1.040 | 81 |
| 1.130 | 53 |
| 1.380 | 38 |
| 1.455 | 174 |
| 1.785 | 411 |
| 1.908 | 107 |

In summary Example 1 shows that chips having substrates made from PMMA and other similar polymeric materials can be actuated to provide strong useful resonances, but that the actuation frequencies cannot be determined as for the conventional silicon or glass chips based on the dimensions of the microfluidic flow channel alone, but rather requires considering the resonances in the whole substrate including the microfluidic flow channel.

Further it should be noted that in the FIGS. 1E-1L the force at the side walls of the channel is non-zero.

Further simulations show that the radiation force $F_{rad}$ and the acoustic energy density $E_{ac}$ is only weakly affected by a gap between the ultrasound transducers or a lateral shift of the flow channel.

EXAMPLE 1B

Simulation Comparing Asymmetric and Symmetric Actuation

Materials and Method

As in example 1 for $W_S$=3.0 mm and a total height of the chip=1.18 mm. The frequency f=1.745 MHz was selected and simulations were performed for an asymmetric actuation and symmetric actuation.

Results

Figure 1M:
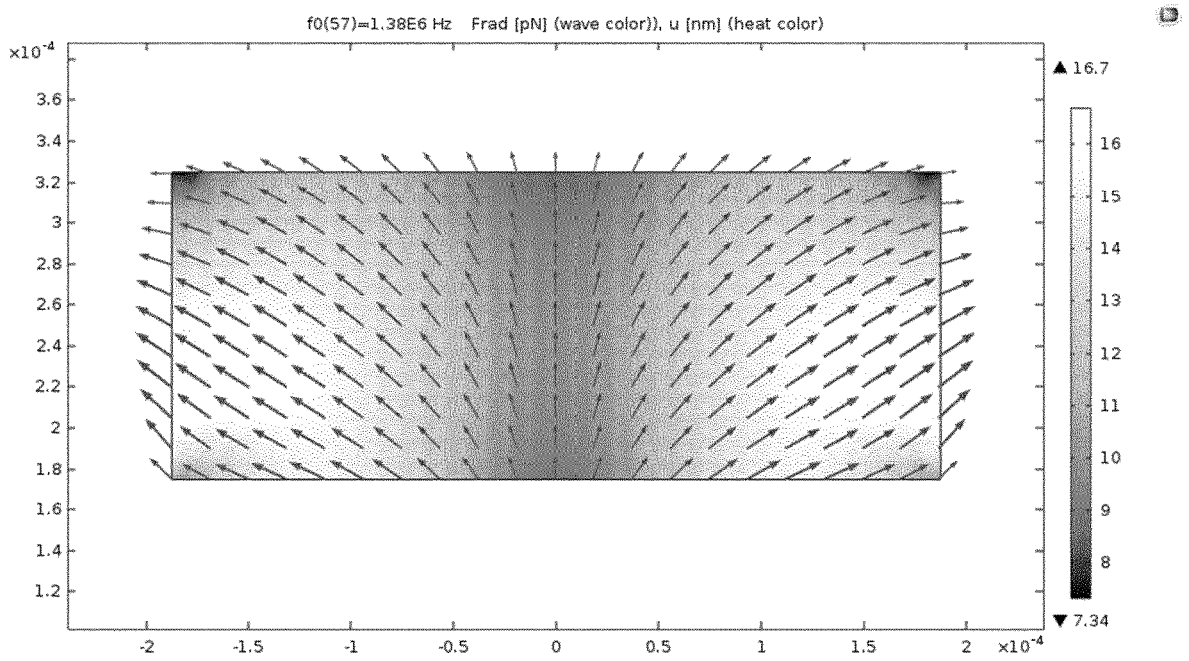

FIG. 1M shows $F_{rad}$ for symmetric actuation at 1.380 MHz. The force vectors are directed towards the side walls of the channel.

Figure 1N:
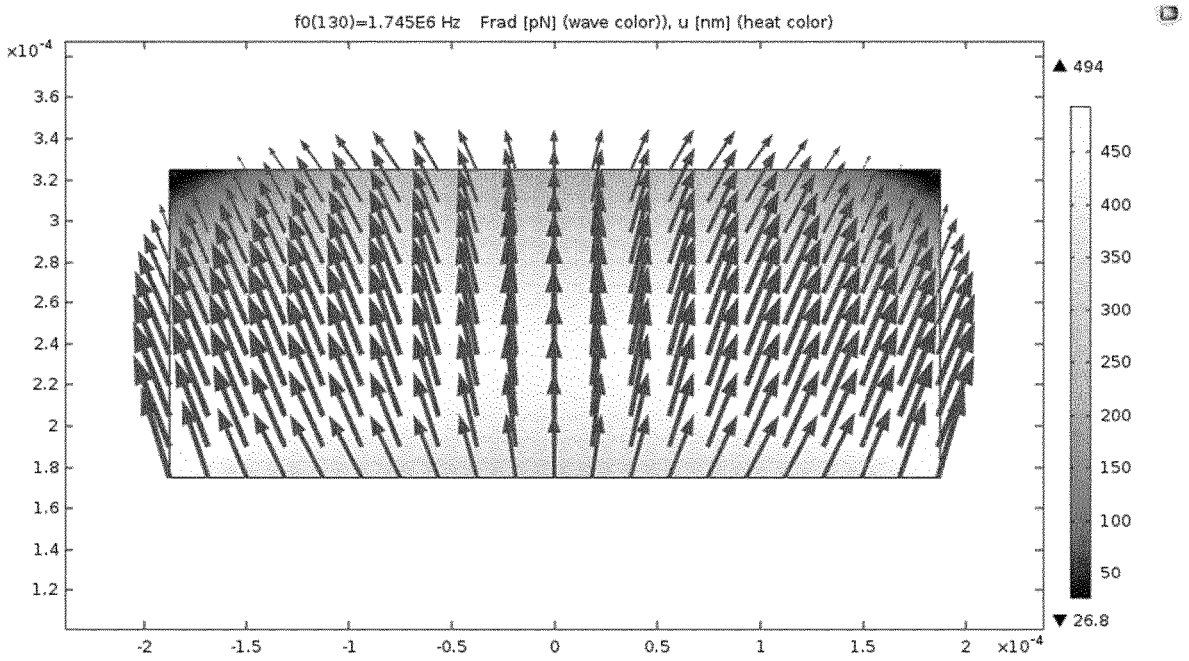

FIG. 1N shows $F_{rad}$ for symmetric actuation at 1.745 MHz. The force vectors are directed towards the ceiling of the channel and also towards the side walls of the channel.

EXAMPLE 2

3D Simulation of Part of PMMA Chip

Materials and Method

A PMMA chip 1B, see example 4 for dimensions was simulated using the parameters of example 2. The simulation was made using the ¼-symmetry:

$$0<x<L_s/2L_s=40 \text{ mm}$$

$$0<y<W_s/2W_s=3 \text{ mm}$$

$$0<z<H_s\ H_s=1.18 \text{ mm}$$

The asymmetric actuation, defined as (0.1 nm)*tan h(50*y/Ws) was applied in the xy plane at z=0.

The xy plane at y=0 has antisymmetric boundary conditions due to actuation and the yz-plane at x=0 has symmetrical boundary conditions due to the symmetry away from the center plane in the chip along the x-axis.

Results

Figure 2A:
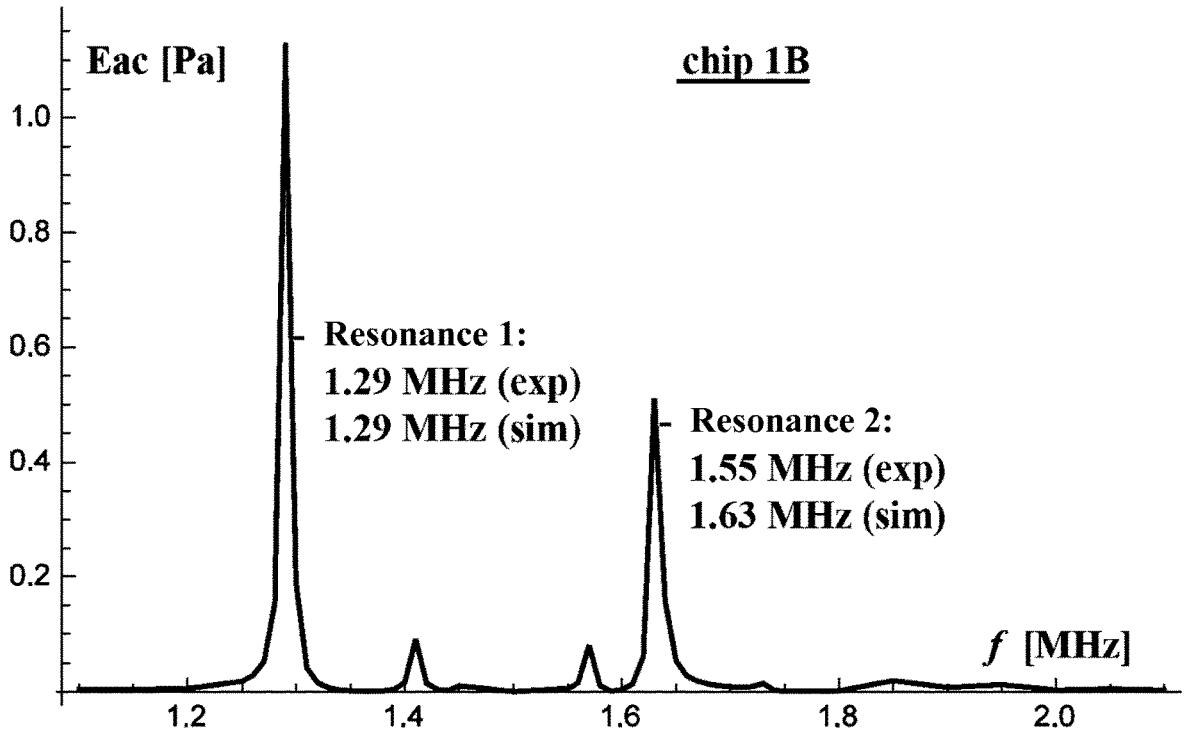

The two largest resonances, as measured using the acoustic energy $E_{ac}$ was found for 1.29 MHz, which corresponds exactly to the experimental value, see example 4, and 1.63 MHz which is about 105% of the experimental value of 1.55 MHz, see FIG. 2A.

Figure 2B:
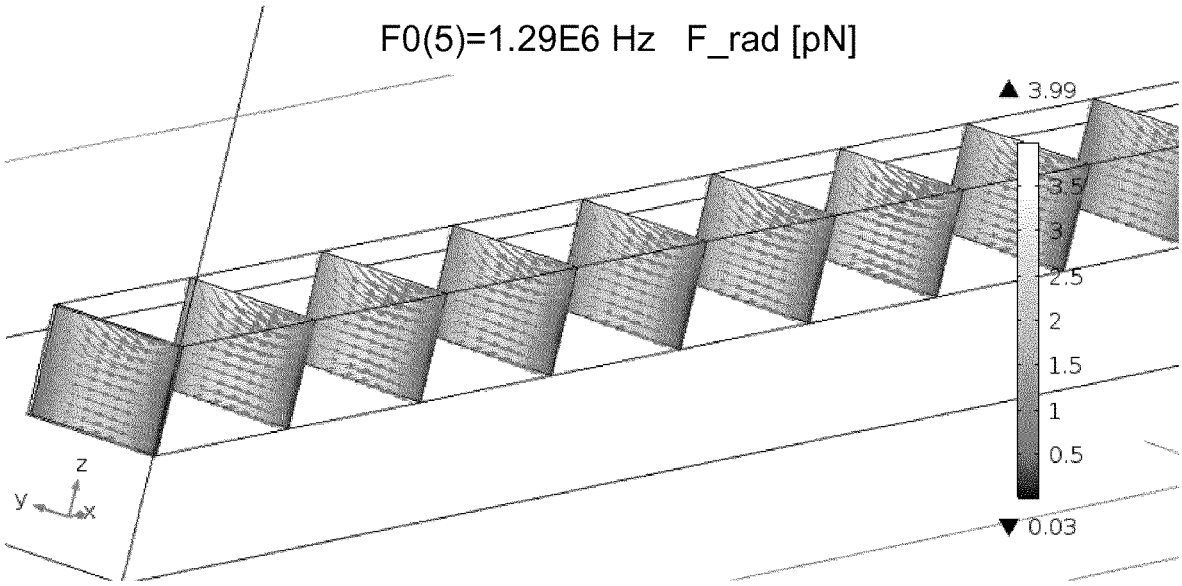

For 1.29 MHz the maximum $F_{rad}$ was 4.0 pN (note here that the amplitude of the actuation is 1/10 of the amplitude used in example 1, hence the lower $F_{rad}$. FIG. 2B shows the quarter of the flow channel along the section 0<z<0.8 mm, as seen the force vectors point towards the center of the channel (y=0)—this would yield a qualitatively good focusing of particles into a vertical band at the center of the flow channel.

Figure 2C:
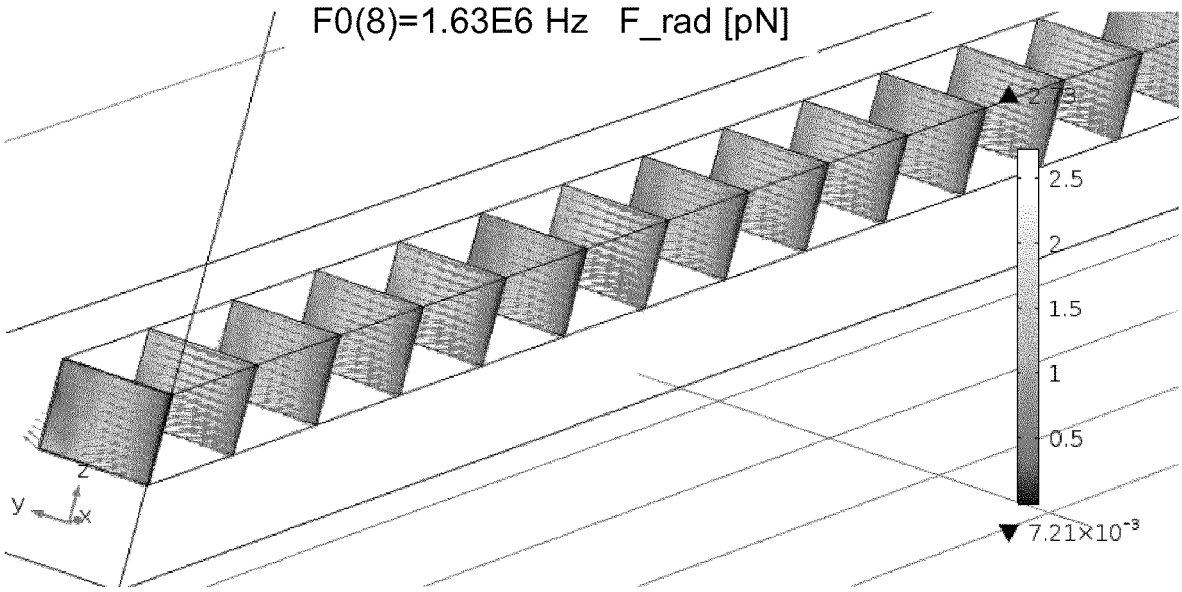

For 1.63 MHz the maximum $F_{rad}$ was 2.7 pN. FIG. 2C shows the quarter of the flow channel along the section 0<z<1.3 mm, as seen the force vectors point towards the center of the channel (y=0)—this would yield a qualitatively good focusing of particles into a vertical band at the center of the flow channel.

EXAMPLE 3

3D Simulation of Full Chip

Materials and Method

Chips 1B ($W_S$=3.0 mm) and 1F ($W_S$=5.0 mm), both having the height ($H_S$=1.18 mm) and length ($L_S$=50 mm) over the full height using the quarter vertical transverse symmetry plane and the vertical axial anti-symmetry to reduce the geometry to a quarter ($0<x<L_S/2$=25 mm and $0<y<W_S/2$=1.5 mm or 2.5 mm) as in example 2.

Results

The table below compares the resonance frequencies predicted by the simulation with those identified in the experiments, see example 4.

Chip 1B

| Resonance | f (MHz)/ $F_{rad}$ (pN) | f (MHz)/ $F_{rad}$ (pN) | f (MHz)/ $F_{rad}$ (pN) | f (MHz)/ $F_{rad}$ (pN) |
|---|---|---|---|---|
| Simulation | 1.132/0.38 | 1.277/0.05 | 1.381/0.20 | 1.455/0.88 |
| Experiment | 1.29 | — | — | 1.550 |

Figure 3A:
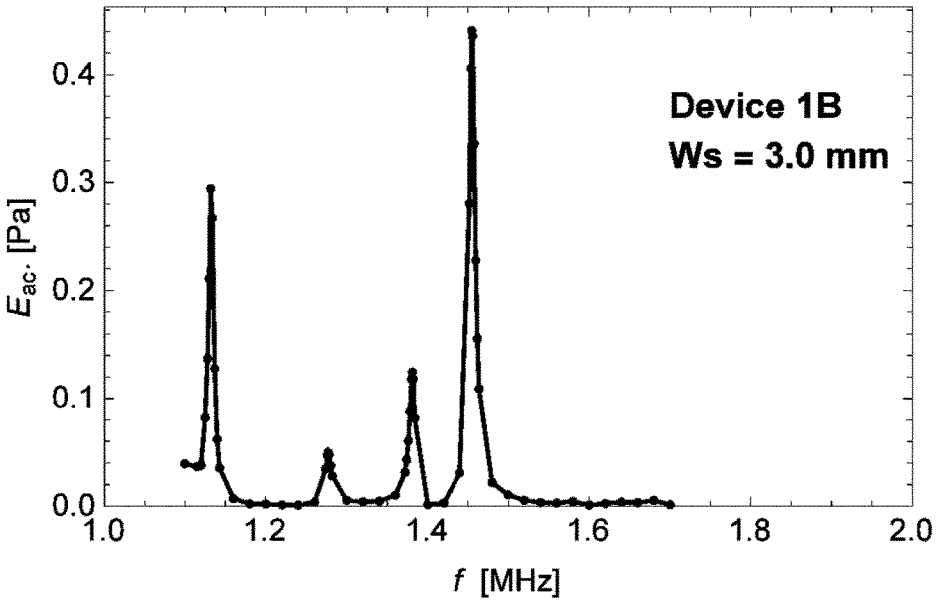
Figure 3B:
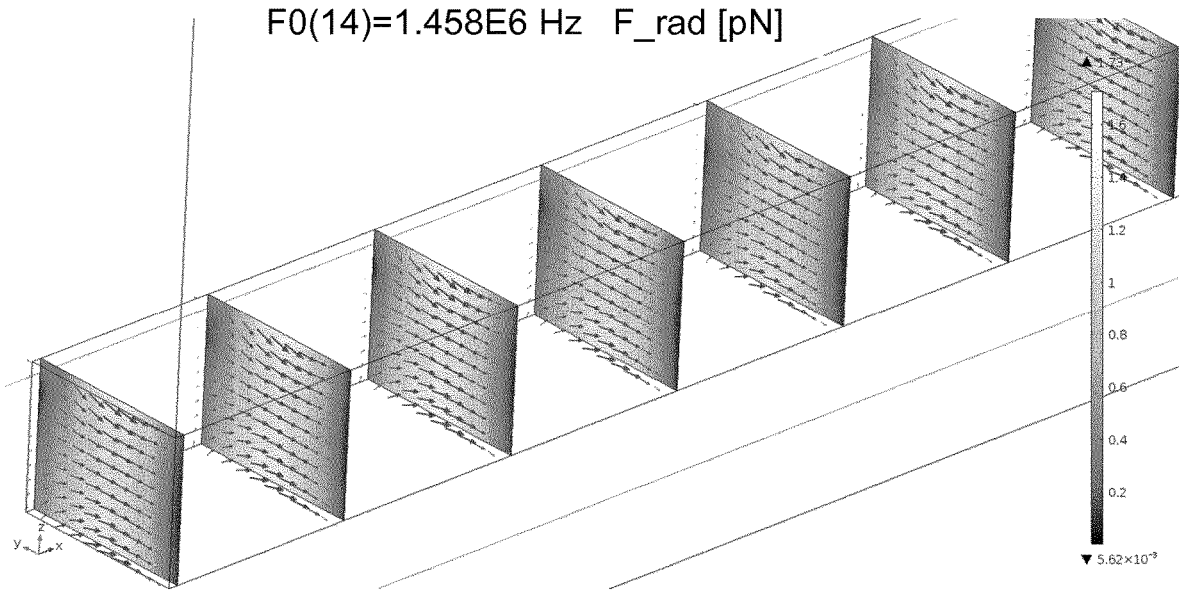

FIG. 3A shows the acoustic energy $E_{ac}$ for chip 1B, and FIG. 3B shows $F_{rad}$ in the center of the channel for f=1.456 MHz.

Chip 1F

| Resonance | f (MHz)/ $F_{rad}$ (pN) | f (MHz)/ $F_{rad}$ (pN) | f (MHz)/ $F_{rad}$ (pN) | f (MHz)/ $F_{rad}$ (pN) | f (MHz)/ $F_{rad}$ (pN) |
|---|---|---|---|---|---|
| Simulation | 1.027/ 0.07 | 1.330/0 | 1.415/ 1.05 | 1.731/ 0.54 | 1.790/ 0.31 |
| Experiment | 1.120 | 1.330 | 1.460 | 1.770 | — |

Figure 3C:
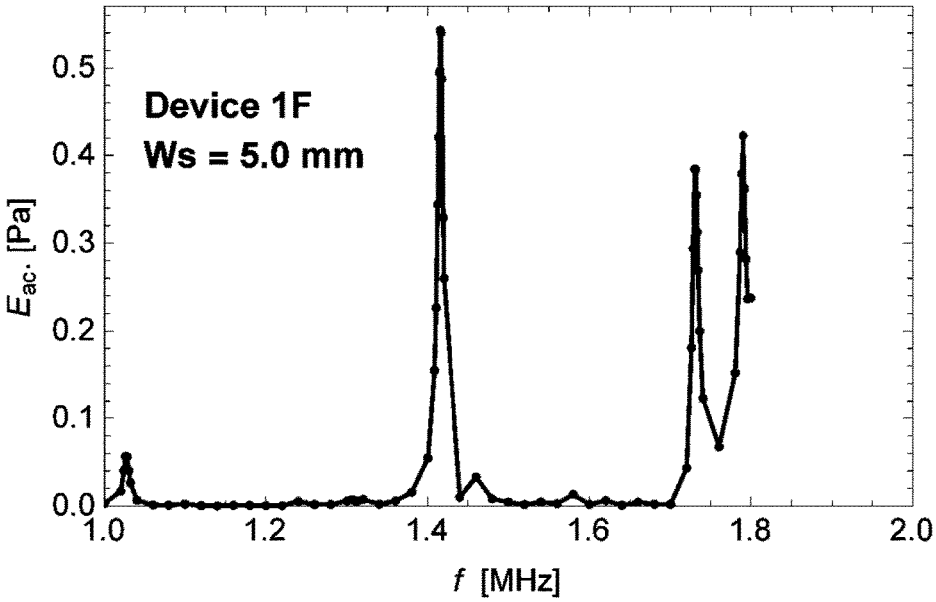
Figure 3D:
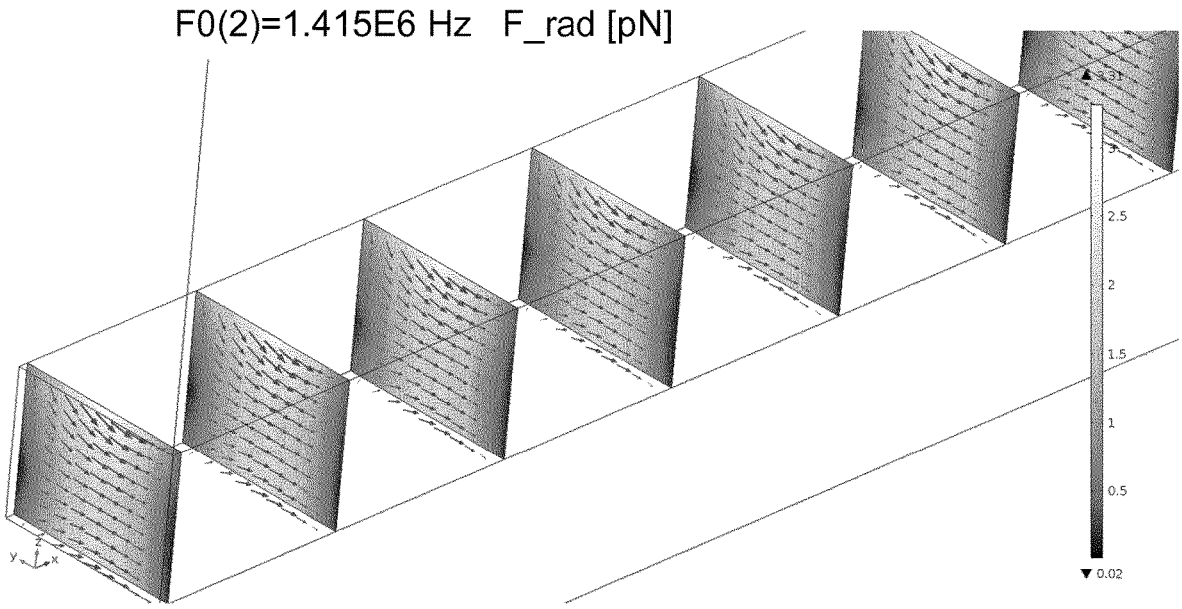

FIG. 3C shows the acoustic energy $E_{ac}$ for chip 1F, and FIG. 3D shows $F_{rad}$ in the center of the channel for f=1.415 MHz.

Where not explicitly discussed in example 4 the experimental resonance frequencies in the above tables were determined as in example 4.

EXAMPLE 4

Evaluation of Prototype PMMA Chips

Materials and Method

A number of 20 PMMA chips were ordered from Microfluidic ChipShop, Germany.

The basic common properties for all chips are given in the table below:

| | |
|---|---|
| Chip material | PMMA |
| Chip length | 50 mm |
| Lid thickness $H_{lid}$ | 175 μm |
| Channel length (1) | 40 mm |
| Channel width (w) | 375 ± 15 μm |
| Channel depth (h) | 150 ± 15 μm |

A number of parameters were varied as detailed in the table below:

| Chip name | Chip width (W) (mm) | Substrate thickness ($H_{base}$) (mm) | Width of Piezoceramic transducer (mm) | Thickness of Piezoceramic transducer (mm) | Transducer position |
|---|---|---|---|---|---|
| 1A | 3 | 1.18 | 5 | 1 | Opposite* |
| 1B | 3 | 1.18 | 5 | 1 | |
| 1C | 5 | 1.8 | 5 | 1 | |
| 1D | 5 | 1.75 | 7 | 1 | |
| 1E | 5 | 1.18 | 7 | 1 | Misaligned |
| 1F | 5 | 1.18 | 7 | 1 | |
| 2A | 3 | 1.18 | 5 | 2.2 | |
| 2B | 3 | 1.68 | 5 | 2.2 | Opposite* |
| 2C | 5 | 1.69 | 7 | 2.2 | |
| 2D | 5 | 1.18 | 7 | 2.2 | |

*Here the transducer was attached to the base substrate, and not onto the lid substrate. Thus the transducers in these chips were further away from the flow channel than in the other chips.

The microfluidic flow channel was provided on one surface of the substrate to which the lid was bonded so as to seal the channel. A planar piezoceramic crystal was provided with a common grounded single bottom electrode attached to its bottom surface. First and second top electrode were formed on the top surface by deposition on an electrode material after which the electrode material was divided into the first and second top electrodes by sawing through the electrode material and approximately 400 μm into the top surface of the piezoceramic crystal. The gap between the first and second top electrodes was approximately 100 μm.

For the evaluation, a solution of 8 μm diameter polystyrene beads in water with Tween (detergent) was used. The piezoceramic crystal was actuated in an asymmetric manner, i.e. with the part of the piezoceramic crystal defined between the first top electrode and the single bottom electrode being actuated out of phase, by 180°, to the part of the piezoceramic crystal defined between the second top electrode and the single bottom electrode. The frequency was manually scanned in 10 kHz steps from 0.6 to 2 MHz. The function generator was set to 10 Vpp with a 180° phase difference between the transducers.

Results

The table below shows the different resonance frequencies $f_1$, $f_2$, $f_3$, $f_4$ found for each chip.

| Chip name | $f_1$ (MHz) | $f_2$ (MHz) | $f_3$ (MHz) | $f_4$ (MHz) |
|---|---|---|---|---|
| 1A | 1.3 | 1.82 | 1.98 | |
| 1B | 1.29 | 1.55 | | |
| 1C | 0.96 | 1.3 | 1.56 | 1.8 |
| 1D | 1.03 | 1.27 | 1.7 | |
| 1E | 1.34 | 1.45 | 1.69 | |
| 1F | 1.12 | 1.33 | 1.46 | 1.7 |
| 2A | 1.16 | Testing was discontinued for these chips | | |
| 2B | 1.2 | after finding the first resonance frequency | | |
| 2C | 1.25 | $f_1$ | | |
| 2D | 1.11 | | | |

Figure 4A:
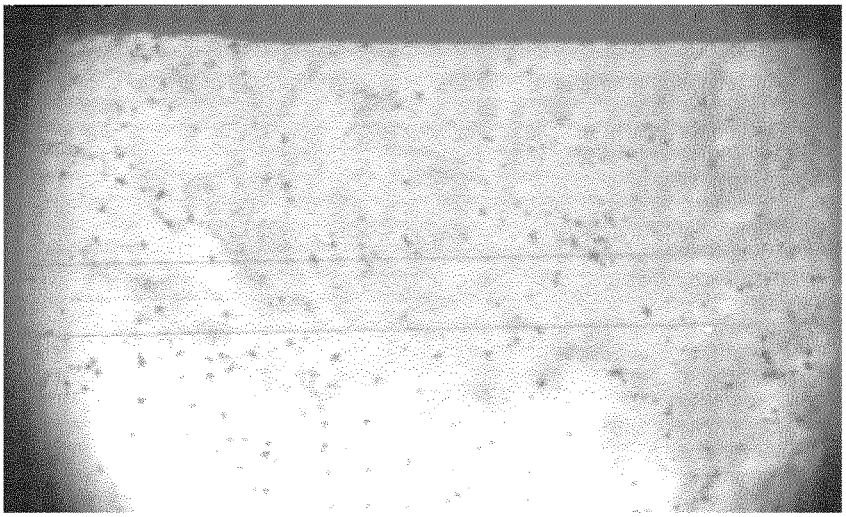

FIG. 4A shows a microscope bright field image of chip 1A, showing the channel.

Figure 4B:
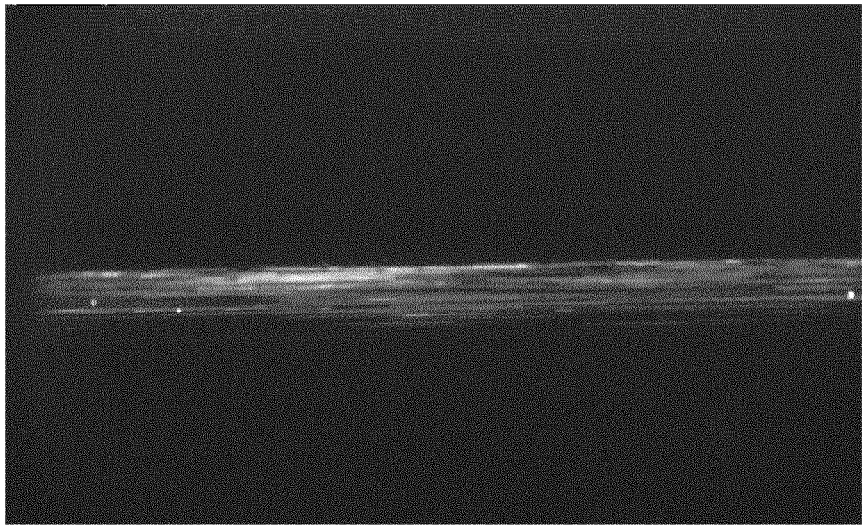

FIG. 4B is a fluorescence image showing beads in channel without ultrasound at 50 μl/min. As seen from the image there is no focusing of the beads in the channel.

Figure 4C:
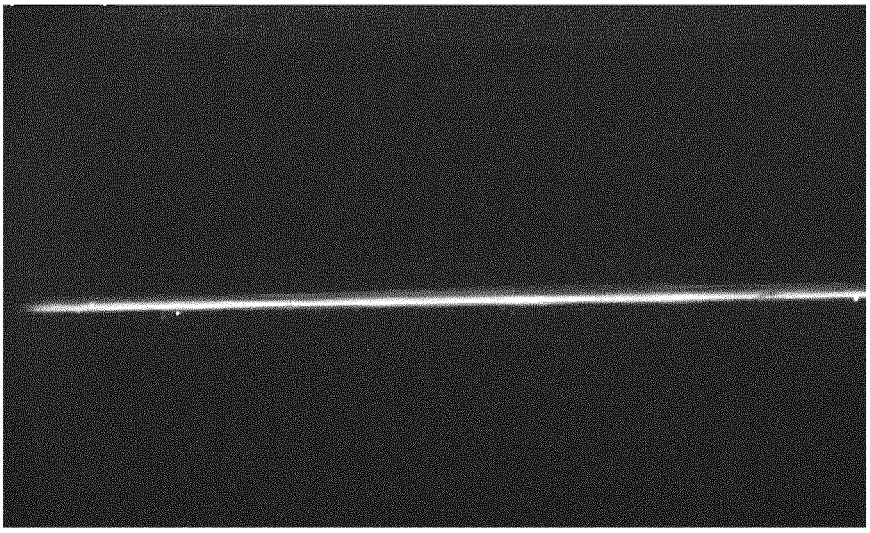

FIG. 4C shows how beads are focused to the center of the channel when the chip is actuated asymmetrically at a frequency of 1.3 MHz, with an amplitude of 10 $V_{pp}$, and at a flowrate of 50 μl/min.

Further resonances, i.e. acoustophoretic focusing effects, were obtained at 1.82 and 1.98 MHz also at 50 μL/min.

These results should firstly be compared to the simulations, see example 1, of resonance frequencies in a chip with a width $W_B$ of 3.0 mm, se FIG. 1C. Here the simulation predicts a resonance at 1.225 MHz (1.3 MHz) 1.590 MHz, and 1.860 MHz (1.82 MHz, 1.98 MHz). Accordingly the qualitative results of the simulations, i.e. that there are effective actuation frequencies that are not determined by the dimensions of the microfluidic flow channel, are confirmed in the experiments.

Secondly, these results may also be compared to previous attempts were significantly higher ultrasound energies, such as 70 Vpp, has been used in order to be able to focus particles at the same flow rate.

Figure 4D:
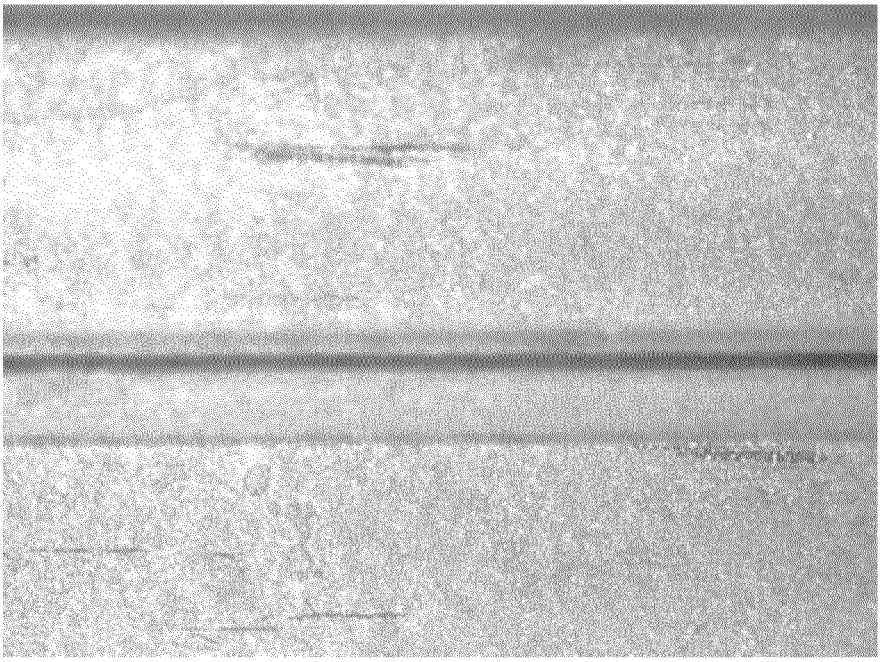

FIG. 4D shows a microscope bright field image of chip 1B, which is of the same type as chip 1A.

Figure 4E:
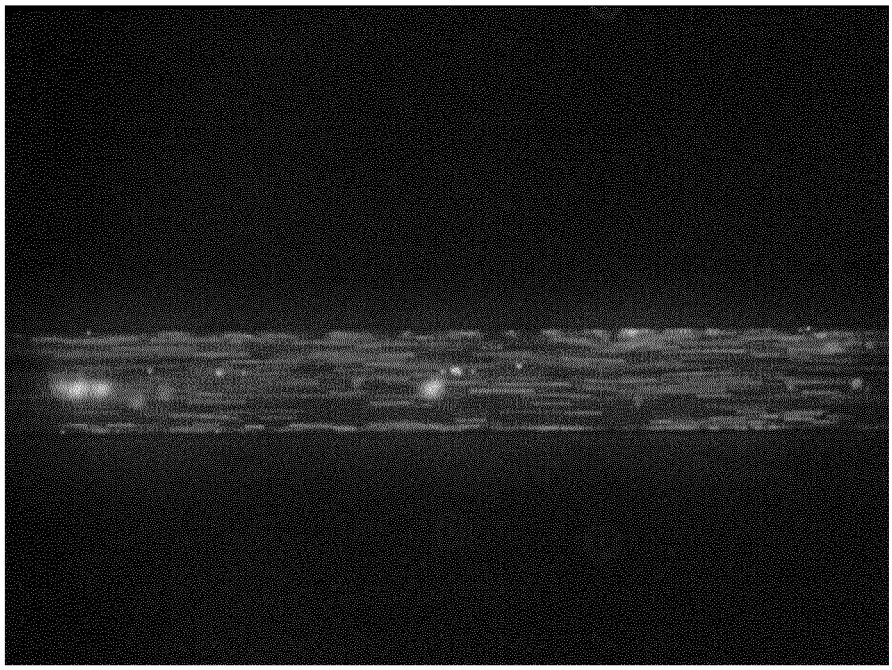

FIG. 4E is a Fluorescence image showing beads in channel without ultrasound at 50 μL/min. As seen from the image there is no focusing of the beads in the channel.

Figure 4F:
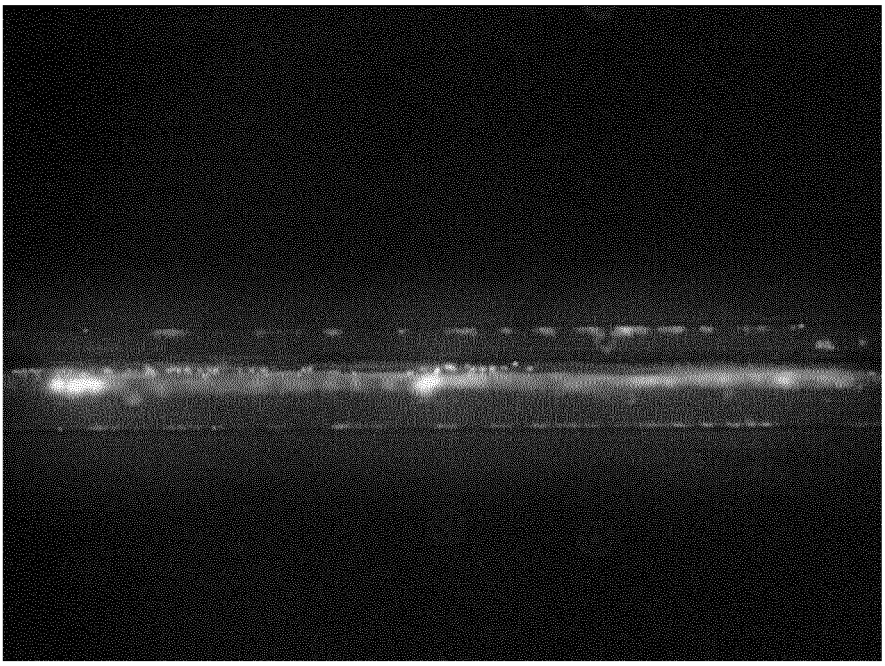

FIG. 4F shows how beads are focused to the center of the channel when the chip is actuated asymmetrically at a frequency of 1.55 MHz, with an amplitude of 10 $V_{pp}$, and at a flowrate of 100 μl/min.

Figure 4G:
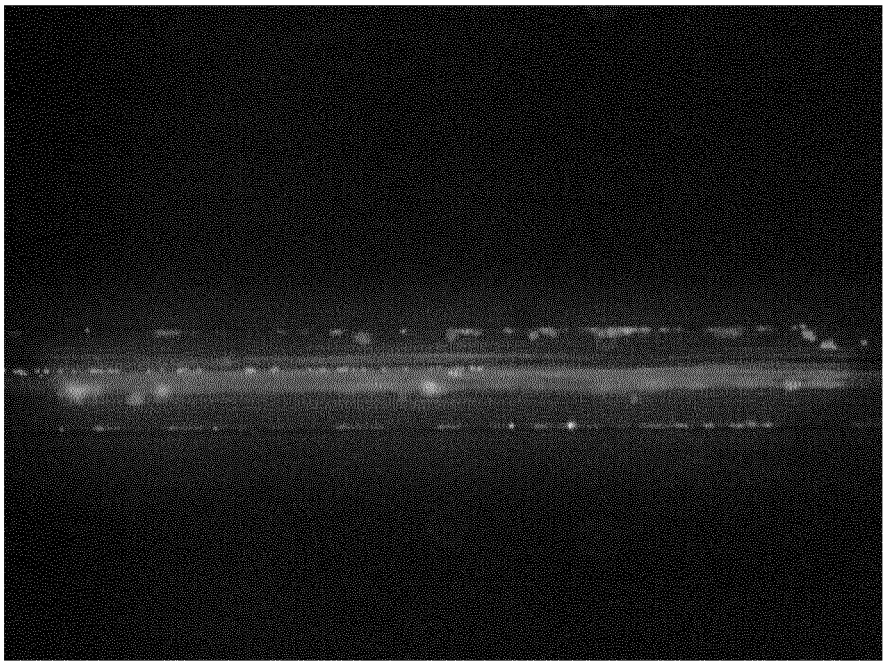

FIG. 4G shows how beads are focused to the center of the channel when the chip is actuated asymmetrically at a frequency of 1.55 MHz, with an amplitude of 10 $V_{pp}$, and at a flowrate of 200 μl/min.

Further resonance, i.e. acoustophoretic focusing effects, were obtained at 1.29 MHz at 150 μL/min.

Here the simulations predicts a resonance at 1.225 MHz (1.3 MHz) 1.590 (1.55 MHz) MHz, and 1.860 MHz. Thus also here the simulation results are confirmed at least quantitatively.

At the higher flowrates shown in FIGS. 4F and 4G the separation efficiency is decreased as some particles are not focused into the center of the channel but instead occupies positions along the walls. However, it should be noted that these results are obtained at low ultrasound energies (10 $V_{pp}$) and at very high flow rates (100-200 μL/min).

Symmetric actuation of the chips resulted in the particles being pushed towards the walls of the channel, the reverse to focusing, as detailed in the below table. This unexpected feature is not possible for particles with positive acoustic contrast in silicon/glass chips and not predicted by the one-dimensional channel resonance model that is normally used for channel design. It was, however, now predicted by whole substrate resonance simulation, see example 1.

| Chip name | $f_1$ (MHz) (symmetric) | observation |
|---|---|---|
| 1A | 0.67 | Reverse focusing |
| 1B | 2.02 | Reverse focusing |
| 1C | 2 | Reverse focusing |
| 1D | 2.02 | Reverse focusing |
| 1E | 1.95 | Reverse focusing |
| 1F | 2.39 | Reverse focusing |

-continued

| Chip name | $f_1$ (MHz) (symmetric) | observation |
|---|---|---|
| 2A | 3.01 | Reverse focusing |
| 2B | 2.95 | Reverse focusing |
| 2C | 3 | Reverse focusing |
| 2D | 2.96 | Reverse focusing |

Figure 5A:
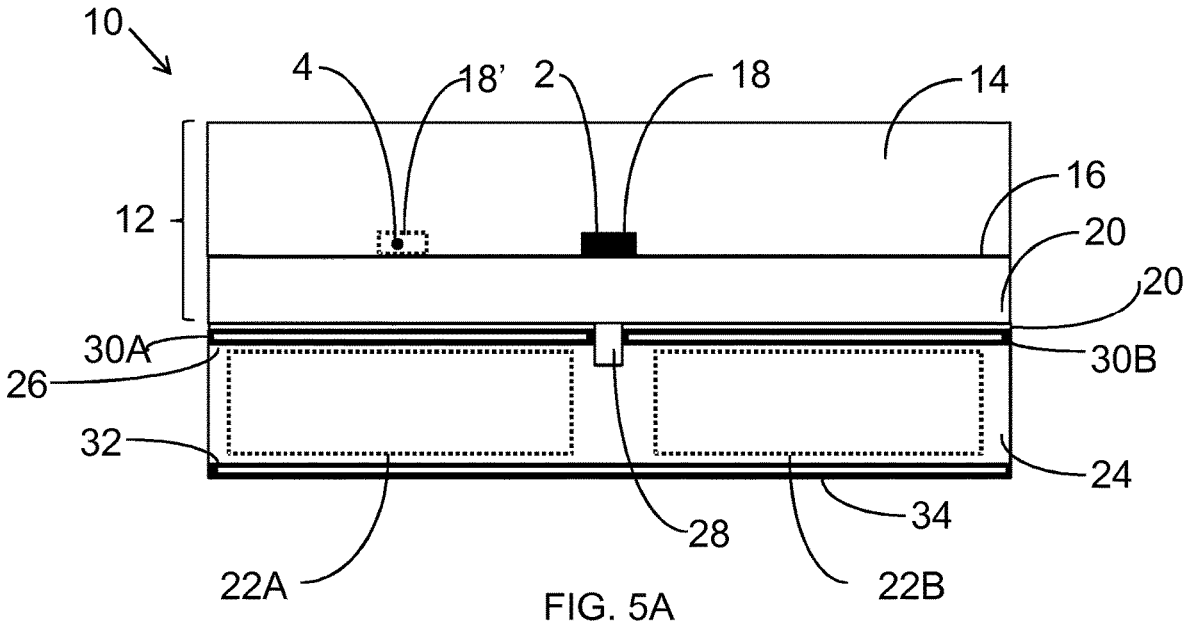

The general construction of an acoustophoretic chip of an acoustophoretic device according to the second aspect of the present invention is shown schematically and in cross section in FIG. 5A. The acoustophoretic chip or device 10 thus comprises a polymeric substrate 12 made up of a base substrate 14 into which lower surface 16 (or upper surface depending on the orientation) a microfluidic flow channel 18 is provided, either during a moulding step when the base substrate is moulded, such as by injection moulding, or in a subsequent step of precision machining, such as by milling. The microfluidic flow channel 18 thus initially resembles a groove or trough on one of the surfaces of the base substrate 14, a floor, or roof depending on the orientation, to the channel 18 is provided by bonding, such as by solvent bonding (where a solvent partially dissolves the surfaces of two objects to be joined) or using an adhesive, a lid substrate 20 to the lower surface 16 of the base substrate 14. A fluid may then be led through the flow channel 18 so as to introduce and/or pass a liquid or fluid sample through the chip 10.

Actuation of the polymeric substrate is provided by first and second ultrasound transducers 22A and 22B which are constructed so as to share a single common piezoelectric crystal 24. An electrode material is provided on the upper surface 26 of the piezoelectric crystal 24, whereafter a cut is made through this layer of electrode material and also preferably, as shown, partially down into the upper surface 26 of the piezoelectric crystal 24 to form a cut-out or groove 28 in the electrode material and the upper surface 26, thus leading to the formation of first and second 30A, 30B spaced apart electrodes. On the bottom surface 32 of the piezoelectric crystal 24 a layer of electrode material is similarly applied, however no cut is needed as this layer is to form a common ground electrode 34 for the first and second electrodes 30A; 30B. The thus formed two ultrasound transducers 22A and 22B are then attached to the lid substrate 20 by a bonding layer of for instance adhesive 36. In operation a liquid or suspension 2 is provided in the flow channel 18. Acoustic forces then affect particles in the liquid, such as particle 4 in the further microfluidic flow channel 18', and thereby perform an acoustophoretic operation in the liquid and the particles.

The generally non-homogenous pressure fields arising in the substrate when in resonance, see in particular the simulation results outside the microfluidic channel in inter alia FIG. 1E of example 1, can be used by placing a further, or a plurality of further, microfluidic flow channel(s) 18' in the substrate 12. If the forces arising on the particle 4 in the further microfluidic flow channel are the same as would affect the same particle in the microfluidic flow channel 18, then both microfluidic flow channel 19 and 18' may be used to perform the same acoustophoretic operation. If that is not the case different acoustophoretic operations may be performed in the different flow channels.

It should also be noted that, the ultrasound transducers 22A, 22B here are attached to the lid substrate 20, thus providing a shorter distance between the ultrasound actuators and the microfluidic flow channel 18.

Figure 5B:
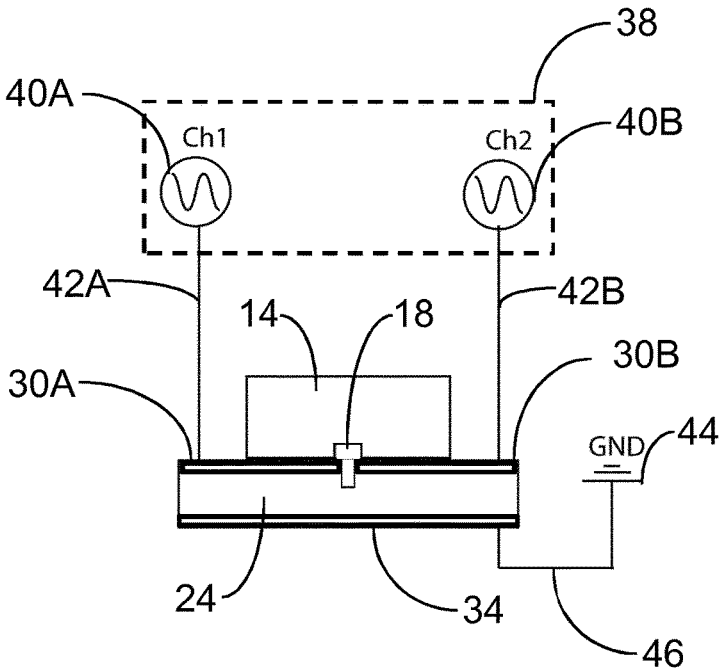

FIG. 5B shows an acoustophoretic device according to the second aspect of the present invention including, in addition to the substrate with the ultrasound transducers shown in FIG. 5A also the drive circuit. Thus a drive circuit 38 includes two function generators 40A and 40B capable of sending out signals at or near a resonance frequency of the substrate 12 including the base substrate 14 and the lid substrate 20 (see FIG. 5A) by first and second signal leads 42A and 42B connected to the first and second electrodes 30A and 30B on the piezoelectric crystal 24. The ground electrode 34 is then connected to ground 44 via a ground lead 46. In operation drive circuit 38 outputs, using function generators 40A and 40B, signals, which preferably are in antiphase, which are led to the first and second electrodes 30A and 30B, so as to actuate the polymeric substrate 12 asymmetrically at the resonance frequency of the polymeric substrate 12 in order to perform an acoustophoretic operation in the channel 18. Preferably, as described earlier, the resonance frequency is the resonance frequency of the combination of the polymeric substrate 12, preferably including the microfluidic flow channel 18, and the ultrasound transducer 22A, 22B (including the piezoelectric crystal 24 with the electrodes 30, 30B and 34).

Figure 5C:
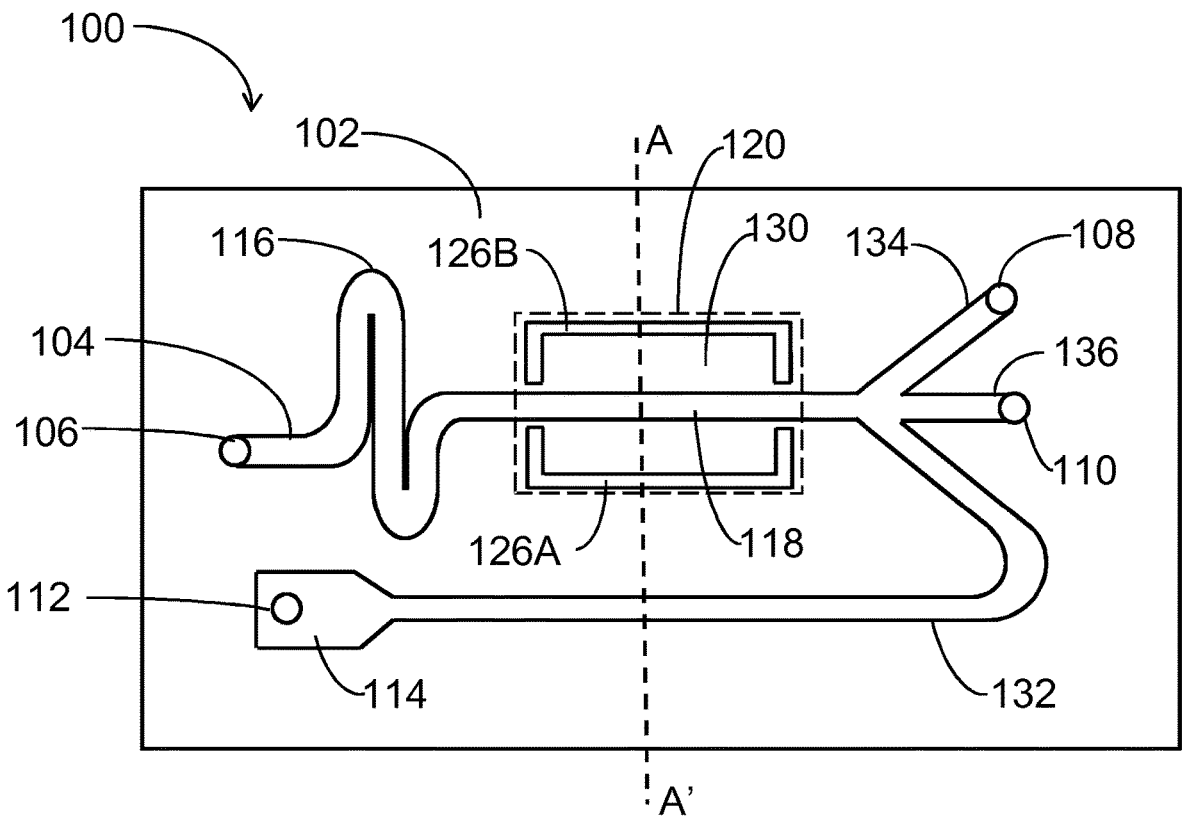
Figure 5D:
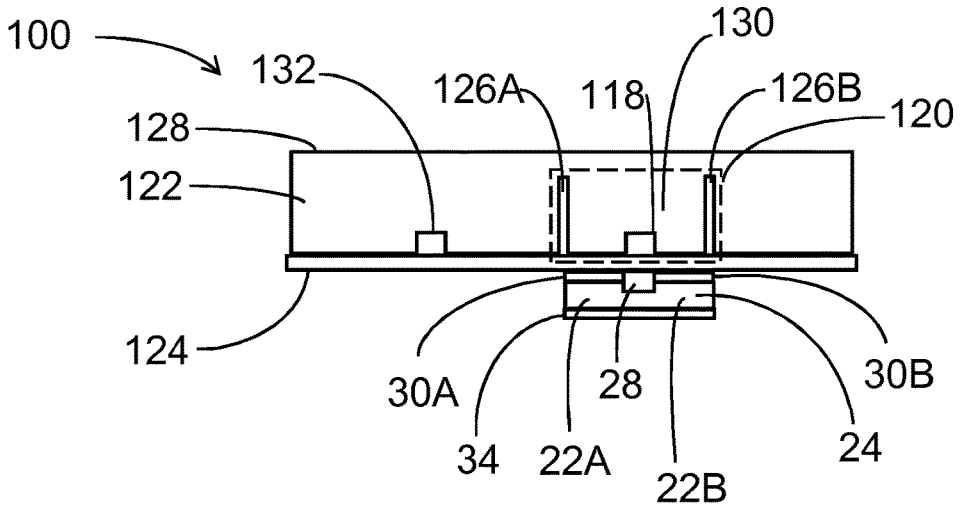

FIGS. 5C and 5D shows a top view and a cross sectional view, respectively, of a microfluidic system 100 according to the fourth aspect of the present invention.

The microfluidic system 100 includes a main substrate 102, which is made from a polymeric material, and which includes at least one microfluidic channel 104 having an at least one inlet 106 and one or more outlets 108, 110, 112, the channel being formed by milling or moulding grooves or troughs in the surface of the main substrate 102. Microfluidic systems typically comprise modules for performing various functions such as mixing, reacting, collecting a fluidic sample, such modules being exemplified by a collection cavity 114 for collecting a fluid sample, and also by holding and/or mixing section 116 in which the channel 104 is convoluted.

As microfluidic systems typically are made from polymeric materials, the inclusion of an acoustophoretic region or module where acoustophoretic operations are to be carried out would be difficult or complicated if silicon or glass were to be used for these functions, as these materials differ from the material of the main substrate 102 of the microfluidic system 100, thus requiring separate manufacturing followed by assembling the silicon/glass parts with the main substrate.

However, as the present invention now provides the possibility of efficiently performing acoustophoretic operations in polymeric materials, the acoustophoretic operations may be performed using a module or chip integrated with the main substrate 102 of the microfluidic system 100. As shown in FIGS. 5C and 5D a section 118 of the microfluidic channel 104 may thus be arranged to pass through a region 120 of the base substrate 102 in which region 120 an acoustophoretic operation is to be carried out. Turning briefly to FIG. 5D, which is a cross section of FIG. 5C through the line AA', it can be seen that the main substrate 102 comprises a main base substrate 122 joined to is joined with a lid substrate 124, which similar to the device in FIG. 5A serves to define the floor or ceiling of the channel 118. Similarly to FIGS. 5A and 5B the ultrasound transducers 22A and 22B are attached to the lid substrate 124 opposite the region 120. To further isolate the region 120 from the remainder of the main substrate material cutouts or groove 126A and 126B are provided around the region 120, these grooves may even pass right through the main base substrate 122 all the way to the other surface 128 so as to define a chip 130 that is integrated in the base substrate 102 and which only connects to the remainder of the base substrate 102 where the channel 118 enters and exits the region 120.

Thus in use the ultrasound transducers 22A and 22B are actuated. A sample flowing through the region 120 is exposed to acoustic forces in the channel 118, such as for example forces that focus particles towards the center of the channel 118. Where the channel 118 branches into the first and second side channels 132 and 134, the concentrated and focused particles thus flow, due to the laminar nature of the flow, into the central channel 136 and outlet 110, whereas other parts of the sample are led to outlet 108 and 112.

Figure 6A:
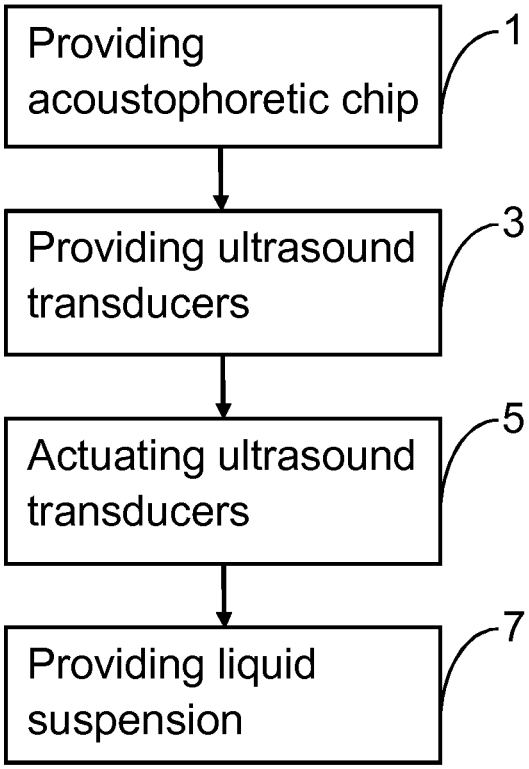

FIG. 6A shows the method according to the first aspect of the present invention, including the steps of:

providing, designated the reference numeral 1, an acoustophoretic chip comprising a polymer substrate in which a microfluidic flow channel is positioned, providing, designated the reference numeral 3, at least one ultrasound transducer, in acoustic contact with one surface of the substrate, actuating, designated the reference numeral 5, the at least one ultrasound transducer at a frequency f that corresponds to an acoustic resonance peak of the substrate including the microfluidic flow channel filled with a liquid suspension (2), and providing, designated the reference numeral 7, the liquid suspension in the flow channel to perform the acoustophoretic operation on the liquid suspension.

Figure 6B:
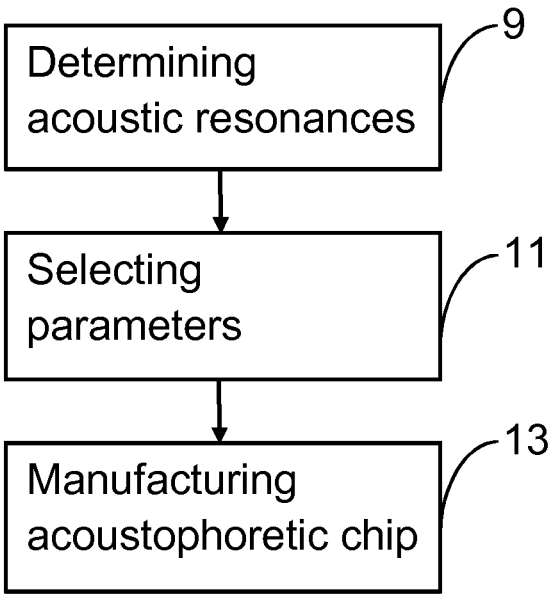

FIG. 6B shows the method according to the third aspect of present invention, including the steps of:

determining, designated the reference numeral 9, by calculation or simulation, the acoustic resonances of the substrate for each of a plurality of different combinations of parameter values of substrate parameters, the substrate parameters including polymeric substrate material, substrate dimensions, microfluidic flow channel dimensions, microfluidic flow channel positions within the substrate, properties of a liquid in the microfluidic flow channel, positions for at least one ultrasound transducer, and actuation frequency f, and Selecting, designated the reference numeral 11, among the plurality of different combinations of the parameter values of the substrate parameters, a polymeric substrate material M, a set of substrate dimensions $D_S$, a set of microfluidic flow channel dimensions $D_C$, a microfluidic flow channel position $P_C$ within the substrate, properties of the liquid L in the microfluidic flow channel, a position $P_U$ for at least one ultrasound transducer, and an actuation frequency f, which yield acoustic resonance within the substrate including the microfluidic flow channel, and manufacturing, designated the reference numeral 13, the acoustophoretic chip made out of the substrate material M having the substrate dimensions $D_S$ and being provided with a microfluidic flow channel having the microfluidic flow channel dimensions $D_C$ and the microfluidic flow channel position $P_C$ within the substrate.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equivalents thereof. Thus, the equipment may be modified in all kinds of ways within the scope of the appended claims.

For instance, it shall be pointed out that structural aspects of embodiments of the method according to the first aspect of the present invention shall be considered to be applicable to embodiments of the system according to the second aspect of the present invention, and conversely, methodical aspects of embodiments of the system according to the second aspect of the present invention shall be considered to be applicable to embodiments of the method according to the first aspect of the present invention.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

Throughout this specification and the claims which follows, unless the context requires otherwise, the word "comprise", and variations such as "comprises" or "comprising", will be understood to imply the inclusion of a stated integer or steps or group of integers or steps but not the exclusion of any other integer or step or group of integers or steps.

Further embodiments of aspects of the invention are set out in the following points:

1. A method of performing an acoustophoretic operation, comprising the steps of:
   a. providing an acoustophoretic chip (10) comprising a polymer substrate (12) in which a microfluidic flow channel (18) is positioned,
   b. providing at least one ultrasound transducer (22A, 22B) in acoustic contact with the substrate,
   c. actuating the at least one ultrasound transducer at a frequency f that corresponds to an acoustic resonance peak of at least the substrate, preferably including the microfluidic flow channel filled with a liquid suspension (2), and
   d. providing the liquid suspension in the flow channel to perform the acoustophoretic operation on the liquid suspension.

2. The method according to point 1, wherein the acoustic resonance peak corresponds to three-dimensional volume resonance in the substrate, preferably including the microchannel, which three-dimensional volume resonance cannot be described as a one- or two-dimensional resonance in the substrate.

3. The method according to point 1 or 2 where the frequency f does not correspond to a resonance frequency of the channel alone.

4. The method according to any of the point 1-3, wherein in step b at least two ultrasound transducers (22A, 22B) are provided in acoustic contact with the substrate, and wherein in step c the at least two ultrasound transducers are actuated out of phase, preferably in antiphase, with respect to each other.

5. The method according to point 4, wherein the at least two ultrasound transducers share a single common piezoelectric crystal (24).

6. The method according to any of the points 1-5, wherein the acoustophoretic operation comprises focusing particles, suspended in a suspension within the microfluidic flow channel, towards one or more discrete areas of the microfluidic flow channel.

7. A device for performing an acoustophoretic operation, comprising:
   an acoustophoretic chip (10) comprising a polymer substrate (12) and a microfluidic flow channel (18) positioned within the substrate,
   at least one ultrasound transducer (22A, 22B) in acoustic contact with the substrate, and
   a drive circuit (38) connected to the at least one ultrasound transducer and being configured to actuate the at least one ultrasound transducer at a frequency f that corresponds to an acoustic resonance peak of at least the substrate, preferably including the microfluidic flow channel filled with a liquid suspension.

8. The acoustophoretic device according to point 7, comprising at least two ultrasound transducers (22A, 22B) in acoustic contact with the substrate, wherein the drive circuit is further configured to actuate the at least two ultrasound transducers, out of phase relative to each other, at the acoustic resonance frequency f.

9. The acoustophoretic device according to any of the points 7-8, wherein the substrate additionally comprises a further microfluidic flow channel (18'), the further microfluidic flow channel being positioned so that that an acoustic force arises, due to resonance in the substrate preferably including the microfluidic flow channel and the further microfluidic flow channel, on a target particle (4) in the further microfluidic channel, the acoustic force being the same, or different, from an acoustic force arising on a target particle in the microfluidic channel.

10. A method of producing an acoustophoretic chip (12) for performing an acoustophoretic operation, the acoustophoretic chip comprising a polymer substrate (12) in which a microfluidic flow channel (18) is provided, comprising the steps of:
   a. determining, by calculation or simulation, the acoustic resonances of the substrate for each of a plurality of different combinations of parameter values of substrate parameters, the substrate parameters including polymeric substrate material, substrate dimensions, microfluidic flow channel dimensions, microfluidic flow channel positions within the substrate, properties of a liquid in the microfluidic flow channel, positions for at least one ultrasound transducer, and actuation frequency f, and
   b. selecting, among the plurality of different combinations of the parameter values of the substrate parameters, a polymeric substrate material M, a set of substrate dimensions $D_S$, a set of microfluidic flow channel dimensions $D_C$, a microfluidic flow channel position $P_C$ within the substrate, properties of the liquid L in the microfluidic flow channel, a position $P_U$ for at least one ultrasound transducer, and an actuation frequency f, which yield acoustic resonance within the substrate including the microfluidic flow channel, and
   c. manufacturing the acoustophoretic chip made out of the substrate material M having the substrate dimensions $D_S$ and being provided with a microfluidic flow channel having the microfluidic flow channel dimensions $D_C$ and the microfluidic flow channel position $P_C$ within the substrate.

11. The method according to point 10, wherein simulation is used in step a, the simulation using as boundaries the polymer/air interface at the outer surfaces of the substrate and the polymer/liquid interface at walls of the microfluidic flow channel.

12. The method according to any of the points 10-11, wherein step a further comprises determining the acoustic force on a target particle (4) throughout the substrate for each of the plurality of different combinations of parameter values of substrate parameters, and step b further comprises determining the set of microfluidic flow channel dimensions $D_C$ and the microfluidic flow channel position $P_C$ within the substrate so that the microfluidic flow channel at least partly delimits a region of the substrate in which the acoustic force on the target particle is suitable for performing the acoustophoretic operation.

13. The method according to any of the points 10-12, wherein the acoustophoretic chip is suitable for performing a further acoustophoretic operation, and wherein the substrate parameters additionally comprises further microfluidic flow channel dimensions and further microfluidic flow channel positions within the substrate, for a further microfluidic flow channel (18').

14. The method according to points 13, wherein the acoustophoretic operation and the further acoustophoretic operation are different, and wherein step b further comprises determining a further set of microfluidic flow channel dimensions $D_{C2}$ and microfluidic flow channel positions $P_{C2}$ within the substrate so that the further microfluidic flow channel at least partly delimits a further region of the substrate in which the acoustic force on a target particle is suitable for performing the further acoustophoretic operation.

15. A microfluidic system comprising a polymeric main substrate (122) having a substrate surface in which is formed a first set of projections, such as walls, or depressions, such as grooves, a polymeric lid substrate (124) placed over the substrate surface so as to define, together with the first set of projections or depressions, at least one microfluidic channel (104), wherein a part (118) of the microfluidic flow channel extends through an acoustophoretic region (120) of the main substrate, in which region an acoustophoretic operation is to be performed, wherein a second set of projections or depressions (126A, 126B) are provided in the polymeric main substrate in or adjacent the acoustophoretic region so as to at least partially separate the acoustophoretic region from the remainder of the polymeric main substrate, and at least two ultrasound transducers (22A, 22B) in acoustic contact with the polymeric lid substrate on the side of the polymeric lid substrate facing away from the substrate surface, the at least two ultrasound transducers being positioned on the polymeric lid substrate so as to cover at least part of the acoustophoretic region, and a drive circuit (38) connected to the at least two ultrasound transducers and being configured to actuate, preferably out of phase or in antiphase, the at least two ultrasound transducers at a frequency f corresponding to a resonance peak of the acoustophoretic region of the polymeric main substrate, preferably including the microfluidic flow channel and/or a part of the polymeric lid substrate facing the acoustophoretic region.

The invention claimed is:

1. A method of performing an acoustophoretic operation, comprising the steps of:

(a) providing an acoustophoretic chip comprising a polymer substrate defining a microfluidic flow channel;

(b) providing at least two ultrasound transducers in acoustic contact with a first surface of the substrate;

(c) actuating the at least two ultrasound transducers at a frequency f that corresponds to an acoustic resonance peak of the substrate including the microfluidic flow channel filled with a liquid suspension; and (d) providing the liquid suspension in the flow channel to perform the acoustophoretic operation on the liquid suspension.

2. The method according to claim 1, wherein the acoustic resonance peak corresponds to a three-dimensional volume resonance in the substrate including the microfluidic flow channel, which three-dimensional volume resonance cannot be described as a one- or two-dimensional resonance in the substrate.

3. The method according to claim 1, where the frequency f does not correspond to a resonance frequency of the channel alone.

4. The method according to claim 1, wherein in step (c), the at least two ultrasound transducers are actuated out of phase with respect to each other.

5. The method according to claim 4, wherein in step (c), the at least two ultrasound transducers are actuated in antiphase with respect to each other.

6. The method according to claim 4, wherein the at least two ultrasound transducers share a single common piezoelectric crystal.

7. The method according to claim 1, wherein the acoustophoretic operation comprises focusing particles, suspended in a suspension within the microfluidic flow channel, towards at least one discrete area of the microfluidic flow channel.

8. An acoustophoretic device for performing an acoustophoretic operation, comprising:

an acoustophoretic chip, comprising a polymer substrate and a microfluidic flow channel in the substrate;

at least two ultrasound transducers in acoustic contact with a first surface of the substrate; and a drive circuit connected to the at least two ultrasound transducers and configured to actuate the at least two ultrasound transducers at an acoustic resonance frequency f that corresponds to an acoustic resonance peak of the substrate including the microfluidic flow channel filled with a liquid suspension.

9. The acoustophoretic device according to claim 8, wherein the drive circuit is further configured to actuate the at least two ultrasound transducers out of phase relative to each other, at the acoustic resonance frequency f.

10. The acoustophoretic device according to claim 8, wherein the drive circuit is further configured to actuate the at least two ultrasound transducers in antiphase relative to each other.

11. The acoustophoretic device according to claim 8, wherein the substrate additionally comprises a further microfluidic flow channel, the further microfluidic flow channel being positioned so that an acoustic force arises, due to resonance in the substrate including the microfluidic flow channel and the further microfluidic flow channel, on a target particle in the further microfluidic channel.

12. A method of producing an acoustophoretic chip for performing an acoustophoretic operation, the acoustophoretic chip comprising a polymer substrate within which a microfluidic flow channel is provided, the method comprising the steps of:

(a) determining an acoustic resonance of the substrate for each of a plurality of different combinations of parameter values, the parameters including polymeric substrate material, substrate dimensions, microfluidic flow channel dimensions, a microfluidic flow channel position within the substrate, properties of a liquid in the microfluidic flow channel, positions for at least two ultrasound transducers in acoustic contact with a first surface of the substrate, and an actuation frequency f of the at least two ultrasound transducers;

(b) selecting, from among the plurality of different combinations of the parameter values of the parameters, a polymeric substrate material M, a set of substrate dimensions $D_S$, a set of microfluidic flow channel dimensions $D_C$, a microfluidic flow channel position $P_C$ within the substrate, properties of the liquid L in the microfluidic flow channel, a position $P_U$ for the at least two ultrasound transducers, and an actuation frequency f of the at least two ultrasound transducers, wherein the selected parameter values yield an acoustic resonance within the substrate including the microfluidic flow channel for performing the acoustophoretic operation; and (c) manufacturing the acoustophoretic chip made out of the substrate material M having the substrate dimensions $D_S$ and being provided with a microfluidic flow channel having the microfluidic flow channel dimensions $D_C$ and the microfluidic flow channel position $P_C$ within the substrate.

13. The method according to claim 12, wherein simulation is used in step (a), the simulation using as boundaries a polymer/air interface at an outer surface of the substrate, and a polymer/liquid interface at walls in the substrate defining the microfluidic flow channel.

14. The method according to claim 12, wherein step (a) further comprises determining an acoustic force on a target particle throughout the substrate for each of the plurality of different combinations of parameter values of substrate parameters, and step (b) further comprises determining a set of microfluidic flow channel dimensions $D_C$ and the microfluidic flow channel position $P_C$ within the substrate so that the microfluidic flow channel at least partly delimits a region of the substrate in which the acoustic force on the target particle is suitable for performing the acoustophoretic operation.

15. The method according to 12, wherein the acoustophoretic chip is configured for performing a further acoustophoretic operation, and wherein the parameters additionally comprise further microfluidic flow channel dimensions and a further microfluidic flow channel position within the substrate, for a further microfluidic flow channel.

16. The method according to claim 15, wherein the step (b) further comprises determining a further set of microfluidic flow channel dimensions $D_{C2}$ and a microfluidic flow channel position $P_{C2}$ within the substrate so that the further microfluidic flow channel at least partly delimits a further region of the substrate in which the acoustic force on a target particle is suitable for performing the further acoustophoretic operation.

17. A microfluidic system, comprising:

an acoustophoretic device, comprising an acoustophoretic chip, comprising a polymeric channel substrate and a microfluidic flow channel in the substrate; at least two ultrasound transducers in acoustic contact with a first surface of the substrate; and a drive circuit connected to the at least two ultrasound transducers and configured to actuate the at least two ultrasound transducers at a frequency f that corresponds to an acoustic resonance peak of the substrate including the microfluidic flow channel filled with a liquid suspension;

a polymeric main substrate having a main substrate surface in which is formed a first set of surface features; and a polymeric lid substrate placed over the main substrate surface so as to define, together with the first set of surface features, at least one microfluidic flow channel;

wherein a part of the microfluidic flow channel extends through an acoustophoretic region of the main substrate, in which acoustophoretic region an acoustophoretic operation is to be performed, the acoustophoretic region defining the acoustophoretic chip;

wherein a second set of surface features is provided in the main substrate in or adjacent to the acoustophoretic region so as to at least partially separate the acoustophoretic region from the remainder of the main substrate;

wherein the at least two ultrasound transducers are in acoustic contact with a side of the lid substrate facing away from the main substrate surface, the at least two ultrasound transducers being positioned on the lid substrate so as to cover at least part of the acoustophoretic region; and wherein the drive circuit is connected to the at least two ultrasound transducers and is configured to actuate the at least two ultrasound transducers at a frequency f corresponding to a resonance peak of the acoustophoretic region of the main substrate including the microfluidic flow channel filled with the liquid suspension and a part of the lid substrate facing the acoustophoretic region.

18. The system according to claim 17, wherein each of the first and second sets of surface features is selected from the group consisting of projections and depressions.

19. The system according to claim 17, wherein the drive circuit is further configured to actuate the at least two ultrasound transducers out of phase relative to each other, at the acoustic resonance frequency f.

20. The system according to claim 17, wherein the channel substrate additionally comprises a further microfluidic flow channel, the further microfluidic flow channel being positioned so that an acoustic force arises, due to resonance in the substrate including the microfluidic flow channel and the further microfluidic flow channel, on a target particle in the further microfluidic channel.

* * * * *